US005648634A

United States Patent [19]

Avory et al.

[11] Patent Number: 5,648,634

[45] Date of Patent: Jul. 15, 1997

[54] ELECTRICAL INITIATOR

[75] Inventors: Mark Lucas Avory, Foster City; William David Fahey, Cupertino; Stewart Shannon Fields, Redwood City; Charles Joyce Moore, Jr., Redwood Shores; Charles John Piper, III, Pleasant Hill; David Whang, San Jose; Terry Joseph Pink, Felton; Albert Jiggs Baggett, Jr., San Carlos; Martin Gerald Richman, Salinas; Lawrence Theodore Weinman, San Ramon, all of Calif.

[73] Assignee: Quantic Industries, Inc., San Carlos, Calif.

[21] Appl. No.: 325,859

[22] Filed: Oct. 19, 1994

Related U.S. Application Data

[63] Continuation-in-part of Ser. No. 140,650, Oct. 20, 1993.

[51] Int. Cl.[6] ..... F42B 3/18; F42C 19/12

[52] U.S. Cl. ..... 102/202.1; 102/202.2; 102/202.5; 102/202.7; 102/202.9; 102/202.14; 149/19.91

[58] Field of Search ..... 102/202.1, 202.2, 102/202.3, 202.5, 202.6, 202.7, 202.8, 202.9, 202.14; 149/19.91

[56] References Cited

U.S. PATENT DOCUMENTS

| | | | |
|---|---|---|---|
| 2,408,125 | 9/1946 | Rolfes | 102/202.2 |
| 2,515,780 | 7/1950 | Lefren . | |
| 2,532,770 | 12/1950 | Huyett . | |
| 2,695,563 | 11/1954 | Mulqueeny . | |
| 2,767,655 | 10/1956 | Seavey . | |
| 2,867,147 | 1/1959 | O'Neill, Jr. . | |
| 2,872,870 | 2/1959 | Gey | 102/86.5 |
| 2,882,819 | 4/1959 | Schulz . | |
| 2,918,001 | 12/1959 | Alford | 102/202.2 |
| 2,955,535 | 10/1960 | Show et al. . | |
| 3,055,780 | 9/1962 | Finnegan et al. . | |
| 3,059,576 | 10/1962 | Haefner . | |
| 3,059,579 | 10/1962 | Bessiere . | |

(List continued on next page.)

FOREIGN PATENT DOCUMENTS

| | | |
|---|---|---|
| 0 314 898 A1 | 10/1989 | European Pat. Off. . |
| 0 402 622 | 12/1990 | European Pat. Off. . |

(List continued on next page.)

OTHER PUBLICATIONS

Non–Disclosure and Proprietary Information Agreement dated Apr. 1, 1992 with associated written communications. NTIS patent search result Abstracts.

(List continued on next page.)

*Primary Examiner*—Harold J. Tudor
*Attorney, Agent, or Firm*—Wilson Sonsini Goodrich & Rosati

[57] ABSTRACT

The invention relates to an electrical initiator which can be used with an automobile air bag or seat belt pretensioner. The initiator comprises a header, a cup, conducting pins, epoxy pin seals, a bridgewire, a primer, and an output charge. In some embodiments, the initiator also includes a director can. The header and the cup are composed of an insulating dielectric material capable of being ultrasonically welded together. The header secures the pins. Each pin is electrically conductive and each is formed with a buttress knurl to form a seal when each pin is inserted into the header. Additionally, the pins are further sealed to the header by an epoxy sealant and the interference fit of the pin to the header. The bridgewire connects the pins together on one side of the header. An electrical signal through the bridgewire generates heat igniting the primer. Primer reacts with the output charge that in turn ignites a solid gas generant that produces gas that fills air bags or activates the gas generator that drives seat belt pretensioners. The primer contacts the bridgewire. The output charge contacts the primer. The output charge is in the cup, and the cup is ultrasonically welded to the header to provide, along with the pin seals, an environmentally secure seal.

10 Claims, 19 Drawing Sheets

U.S. PATENT DOCUMENTS

| | | | |
|---|---|---|---|
| 3,101,669 | 8/1963 | Gatley et al. | 102/202.9 |
| 3,198,117 | 8/1965 | Purdy et al. . | |
| 3,306,202 | 2/1967 | Menicbelli et al. . | |
| 3,320,104 | 5/1967 | Stadler et al. . | |
| 3,351,012 | 11/1967 | Wilson . | |
| 3,357,190 | 12/1967 | Cassidy et al. . | |
| 3,366,054 | 1/1968 | Gruber, Jr. . | |
| 3,414,292 | 12/1968 | Oldberg et al. . | |
| 3,449,999 | 6/1969 | Corren et al. | 86/1 |
| 3,541,961 | 11/1970 | Larson . | |
| 3,557,699 | 1/1971 | Hubbard . | |
| 3,572,247 | 3/1971 | Warshall . | |
| 3,601,655 | 8/1971 | Andersen . | |
| 3,640,224 | 2/1972 | Petrick et al. . | |
| 3,686,934 | 8/1972 | Farrand et al. | 86/1 |
| 3,695,179 | 10/1972 | Rainone et al. . | |
| 3,831,523 | 8/1974 | Thomas et al. | 102/202.1 |
| 3,867,885 | 2/1975 | Gawlick et al. . | |
| 3,906,858 | 9/1975 | Craig et al. . | |
| 3,960,514 | 6/1976 | Teng et al. | 44/7 B |
| 3,971,320 | 7/1976 | Lee | 102/202.9 |
| 4,040,356 | 8/1977 | Voreck, Jr. et al. . | |
| 4,056,416 | 11/1977 | Franklin et al. . | |
| 4,128,058 | 12/1978 | Mixon, Jr. et al. . | |
| 4,152,041 | 5/1979 | Hollyday et al. . | |
| 4,152,988 | 5/1979 | Haas et al. . | |
| 4,170,939 | 10/1979 | Hoheisel et al. . | |
| 4,203,787 | 5/1980 | Kirchoff et al. . | |
| 4,220,088 | 9/1980 | Kimura et al. . | |
| 4,261,263 | 4/1981 | Coultas et al. . | |
| 4,271,453 | 6/1981 | Yajima et al. . | |
| 4,296,084 | 10/1981 | Adams et al. . | |
| 4,299,167 | 11/1981 | Bryan . | |
| 4,306,499 | 12/1981 | Holmes . | |
| 4,307,663 | 12/1981 | Stonestrom . | |
| 4,316,412 | 2/1982 | Dinegar et al. . | |
| 4,363,272 | 12/1982 | Simmons | 102/202.9 |
| 4,369,079 | 1/1983 | Shaw . | |
| 4,369,707 | 1/1983 | Budde . | |
| 4,370,930 | 2/1983 | Strasser et al. . | |
| 4,422,381 | 12/1983 | Barrett . | |
| 4,457,517 | 7/1984 | Dunegan . | |
| 4,561,675 | 12/1985 | Adams et al. . | |
| 4,576,094 | 3/1986 | Meador . | |
| 4,592,280 | 6/1986 | Shores . | |
| 4,612,578 | 9/1986 | Breithaupt | 358/212 |
| 4,616,565 | 10/1986 | Reinovsky . | |
| 4,621,578 | 11/1986 | Vallieres et al. . | |
| 4,648,319 | 3/1987 | Westerlund et al. . | |
| 4,696,231 | 9/1987 | Bryan . | |
| 4,722,551 | 2/1988 | Adams . | |
| 4,726,296 | 2/1988 | Leshner et al. . | |
| 4,729,315 | 3/1988 | Proffit et al. . | |
| 4,734,265 | 3/1988 | Nilsson et al. . | |
| 4,777,878 | 10/1988 | Johnson et al. . | |
| 4,893,109 | 1/1990 | Vrabel et al. . | |
| 4,939,993 | 7/1990 | Curutchet et al. . | |
| 4,943,086 | 7/1990 | Cunningham . | |
| 4,952,629 | 8/1990 | Liang | 525/66 |
| 4,959,011 | 9/1990 | Nilsson . | |
| 4,968,364 | 11/1990 | Bentley . | |
| 4,976,200 | 12/1990 | Benson et al. . | |
| 4,978,482 | 12/1990 | Johnson et al. | 264/3.1 |
| 5,005,486 | 4/1991 | Lenzen . | |
| 5,015,311 | 5/1991 | Ramaswamy . | |
| 5,036,768 | 8/1991 | Dow et al. . | |
| 5,044,278 | 9/1991 | Campbell . | |
| 5,046,429 | 9/1991 | Swann et al. . | |
| 5,054,395 | 10/1991 | Vetter et al. . | |
| 5,060,974 | 10/1991 | Hamilton et al. . | |
| 5,071,362 | 12/1991 | Martens et al. . | |
| 5,076,607 | 12/1991 | Woods et al. . | |
| 5,080,393 | 1/1992 | Dixon, Jr. et al. . | |
| 5,085,146 | 2/1992 | Baginski . | |
| 5,099,762 | 3/1992 | Drapala . | |
| 5,100,170 | 3/1992 | Mihm et al. . | |
| 5,109,772 | 5/1992 | Cunningham et al. . | |
| 5,131,679 | 7/1992 | Novak et al. . | |
| 5,136,952 | 8/1992 | Bennett, Jr. . | |
| 5,140,906 | 8/1992 | Little, II . | |
| 5,167,426 | 12/1992 | Mihm et al. . | |
| 5,178,547 | 1/1993 | Bonas et al. . | |
| 5,200,574 | 4/1993 | Cunningham et al. . | |
| 5,206,455 | 4/1993 | Williams et al. . | |
| 5,275,575 | 1/1994 | Cahaly et al. . | |
| 5,280,927 | 1/1994 | Greisinger . | |
| 5,314,345 | 5/1994 | Cahaly et al. . | |
| 5,334,025 | 8/1994 | Föhl . | |
| 5,337,674 | 8/1994 | Harris et al. . | |
| 5,345,872 | 9/1994 | Takahashi et al. . | |
| 5,375,523 | 12/1994 | Morris . | |
| 5,387,645 | 2/1995 | Montag et al. | 525/66 |
| 5,397,196 | 3/1995 | Boiret et al. . | |
| 5,401,180 | 3/1995 | Muzslay . | |
| 5,454,320 | 10/1995 | Hilden et al. | 102/202.7 |
| 5,482,327 | 1/1996 | Schmid . | |
| 5,490,033 | 2/1996 | Cronin . | |

FOREIGN PATENT DOCUMENTS

| | | |
|---|---|---|
| 0 482 755 A1 | 4/1992 | European Pat. Off. . |
| 0 482 755 | 4/1992 | European Pat. Off. . |
| 0 502 630 A2 | 9/1992 | European Pat. Off. . |
| 0 505 823 | 9/1992 | European Pat. Off. . |
| 0 512 682 A2 | 11/1992 | European Pat. Off. . |
| 0 512 747 A1 | 11/1992 | European Pat. Off. . |
| 2116782 | 6/1972 | France . |
| 2599361A1 | 12/1987 | France . |
| 2599 361 | 12/1987 | France . |
| 2120 043 | 11/1971 | Germany . |
| 2133 050 | 1/1972 | Germany . |
| 2131 479 | 1/1972 | Germany . |
| 2443 267 | 3/1975 | Germany . |
| 2755 649 | 6/1978 | Germany . |
| 3837332 A1 | 10/1990 | Germany . |
| 39 39 258 A1 | 6/1991 | Germany . |
| 4026697 | 3/1992 | Germany . |
| 4224477 | 2/1993 | Germany . |
| 53-96135 | 8/1978 | Japan . |
| 4-24144 | of 1990 | Japan . |
| 1 361 904 | 7/1974 | United Kingdom . |
| 2 238 672 | 5/1991 | United Kingdom . |
| 2 245 775 | 8/1992 | United Kingdom . |
| WO 90/01670 | 2/1990 | WIPO . |

OTHER PUBLICATIONS

U.S. patent search Printout A Abstracts.

U.S. patent search Printout B Abstracts.

U.S. patent search Printout C Abstracts.

U.S. patent search Printout D Abstracts.

Second Written Opinion—International Application No. PCT/US94/12068.

Kraton Thermoplastic Rubber Typical Properties, Shell Chemical Co. 1992.

VALOX Resin Chemical Resistance, Quantic Industries Inc. Vehicle Safety Systems, 3 pages.

VECTRA Liquid Crystal Polymer (LCP), Hoechst Celanese Product Information Services, 7 pages.

"KEL–F" Brand 800 Resin, Product Specification, 3M Chemical Products Division, Technical Data, Commercial Chemicals Division/3M, 5 pages.

FLUOREL FC, Technical Information, Industrial Chemical Products Division/3M, St. Paul, MN, 7 pages.

Solution Behavior of KRATON Thermoplastic Rubbers, Technical Bulletin SC: 72–85, Shell Chemical Company, 13 pages.

Processing and Fabricating KRATON Thermoplastic Rubber Compounds, Shell Chemical Company, 25 pages.

The A Types of 'VITON' Fluoroelastomer A–35, A, A–HV, J. G. Bauerle, Proprietary materials published by DuPont, Elastomer Chemicals Dept., Wilmington, Delaware, 8 pages.

'VITON' B, A Heat– and Fluid–Resistant Fluoroeslastomer, Proprietary Materials Published by DuPont, Elastomers Division, Wilmington, Delaware, 20 pages.

Written Opinion—International Application No. PCT/US94/12068.

PCT International Search Report dated Mar. 3, 1995 from PCT/US94/12068.

ELECTRICAL INITIATOR

RELATED APPLICATION

This application is a continuation in part of U.S. application Ser. No. 08/140,650 by Avory et al., filed on Oct. 20, 1993.

BACKGROUND OF THE INVENTION

The present invention relates to the field of electrical initiators and gas generators. More particularly, the present invention relates to electrical initiators used to ignite gas generators for inflating air bags and for electrically initiated gas generators for seat-belt pretensioners in automobiles during collisions.

Air bags and seat belt pretensioners play an important role in reducing death or injuries in collisions. An initiator has a crucial role in activating these safety mechanisms by quickly converting an electrical signal from a collision detection system to rapidly moving, hot particles. These hot particles ignite a solid gas generant which in turn produces the gas necessary to inflate an air bag or activate a seat-belt pretensioner.

Conceptually, an electrical initiator contains a number of components. It has a header and a cup that are attached together to form a cavity. An initiator also has two electrically conductive pins that provide a conduction path from the outside of the header and cup into the cavity. Inside the cavity, the pins are connected together by an electrically resistive device, called a resistor in this discussion.

When the resistor is composed of a piece of metal, the resistor is called a bridgewire.

The resistor is surrounded by a chemical compound called the primer that is very sensitive to temperature. Adjacent to the primer is another chemical compound called the output charge. The output charge and the primer together are referred to as the ordnance. The ordnance is contained by the formed cavity.

The initiator is contained in a device called a gas generator. For simplicity in describing the operation of an initiator in the context of a safety system, the cup of the initiator can be thought of as being surrounded by a solid chemical called the gas generant. When the solid gas generant is ignited, it produces a gas.

The operation of an initiator begins with the arrival of an electrical signal at the conductive pins. The resistor converts the electrical energy in the signal into thermal energy. That thermal energy causes the resistor temperature to rise which starts a pyrotechnic reaction in the primer. The pyrotechnic reaction in the primer causes a pyrotechnic reaction in the output charge. The increased pressure and heat generated by these reactions causes the cup to rupture. The high pressure spreads hot gases and particles outward to ignite the solid gas generant to produce gas. This gas can then be used to inflate an air bag or move a piston to operate a seat belt pretensioner.

A commercially successful initiator used in automotive safety systems must be fast, reliable and consistent. It also must be economical to construct.

An initiator must be reliable and fast because it must reliably ignite when required and never ignite unintentionally. An initiator can spend years unused in a car before it needs to work. It must be fast because the gas generators must inflate an air bag or tighten a seat belt in time to prevent injury to the automobile occupants. It must be fast so that the safety system designers can make sure that all parts of the safety system work at the precisely the proper time to provide the protection to the occupants.

Some initiators requiring high reliability and consistency use a metal header and employ a glass-to-metal seal or a ceramic-to-metal seal between the pins and the header, and have a metal cup welded to the header. In these initiators one or both pins are fed through the metal header via a glass or ceramic insulator which seals the metal pin to the insulator and the insulator to the metal header. If only one pin is insulated from the header, the header itself acts as part of the conductive path to the cavity.

The glass-to-metal seal or ceramic-to-metal seal is a hermetic seal and is strong enough to hold the pin or pins in place during the time that the initiator is operating. These types of seals isolate the resistor, the primer, and the output charge from external moisture and humidity fluctuations. Moisture in the ordnance reduces the initiator's ability to fire promptly and consistently upon receipt of the proper electrical signal.

An initiator must be economical to build. Glass-to-metal, ceramic-to-metal and metal-to-metal welded seals are expensive. They may be the most expensive aspect of constructing an initiator. Unfortunately, initiators using less expensive materials such as nylon are much less reliable. For instance, an initiator may use a plastic header and cup. Sometimes initiator manufacturers attempt to provide an environmental seal between the header and cup by use of crimps or potting material. Although this type of initiator is less expensive, it does not provide a seal suited for the demands of the automotive environment, nor is it able to provide the long term reliability critical for this type of safety application.

Existing initiators using plastic are not effective in isolating the primer and output charge from the environment. A path for the intrusion of moisture may exist between the pins and the plastic header. For example, some initiators are constructed by molding the pins in the header. The header may pull away from the pins when the injected plastic cools, thus leaving a path for moisture.

Plastic headers and cups have very large coefficients of thermal expansion compared to glass-to-metal headers. Expansion and contraction over a long lifetime, e.g. 15 years, in an automotive environment can mechanically stress the resistor. Fractures in the resistor can cause electrical problems that lead to late firing of the initiator or even complete failure.

Some initiators have the resistor attached to the pins with solder. One problem with this approach is that the solder flux can contaminate the primer. Soldering also does not guarantee a reliable connection. Both of these problems can make the initiator unreliable. In addition, soldering requires additional materials, i.e. solder and flux. This makes an initiator using these materials more difficult and expensive to build than one without those materials.

When properly deployed, the initiator will receive an electrical signal from the sensing system. However, the initiator can be inadvertently triggered by static electricity generated while the initiator is being built or installed. This creates a substantial safety hazard to workers and equipment.

The ideal output charge would have several important characteristics. It would maintain its ignition and combustion characteristics in the presence of moisture. It would produce numerous hot particles to ignite the gas generant. It would also be relatively insensitive to ESD. Although far from ideal, many initiators use black powder as an output charge.

Initiators have used a primer composed of normal lead styphnate (NLS) with nitrocellulose as a binder. However, this primer does not have good heat transfer properties and will fail the no-fire requirement unless a large diameter bridgewire is used, or the primer's heat transfer characteristics are modified. A typical no-fire requirement is that the primer must not ignite 99.9% of the time with a 95% confidence level at 200 milliamps applied for 10 seconds at 85° C. However, a larger bridgewire will cause the initiator to have a slower response time, which may lead to failing the response time requirement and the all-fire requirement. A typical all-fire requirement is that the primer must ignite 99.9% of the time with a 95% confidence level at 800 milliamps applied for 2 milliseconds at −35° C.

Because nitrocellulose is less thermally stable than normal lead styphnate and because it does not provide the primer with good heat transfer characteristics, primers using nitrocellulose have poor long term aging characteristics, poor thermal heat sink capability, and lack the required resiliency to survive thermal and mechanical shock readily. The lack of resiliency means that the primer is stiff and brittle, and therefore is incompatible with an ultrasonic welding process.

SUMMARY OF INVENTION

The present invention provides a low cost electric initiator with high reliability. It achieves the reliability of an initiator having more expensive components by its selection of the pins' structure, the attachment of the pins to the header, the attachment of the header to the cup, attachment of the resistor to the pins, resistor structure, and output charge and primer.

In one embodiment, the present invention uses pins formed with buttress knurls (i.e. barbs). One purpose of the buttress knurls is to hold the pins in place once they are inserted. Another purpose is to form an environmental seal by biting into the plastic at many locations creating a labyrinth seal. When pins having buttress knurls are inserted into a plastic header with the appropriate amount of force, the elastic properties of the plastic cause the header to snap back to seal the pins in place.

To provide an additional seal for the pins, a resilient epoxy is placed in small wells at the bottom of the header where the pins exit the header. The epoxy bonds to the pins and to the header forming another environmental seal on the pins. Preventing leaks via the pins is one of the contributions of the present invention.

In an alternate embodiment, the pin is made without flutes and slightly wider than the intended hole. The environmental seal is established by the interference fit that occurs from forcing such a pin into the hole.

The header and cup of the present invention are each made by injection molding of polybutylene terephthalate (PBT). One suitable plastic is Valox DR48. Valox DR48 is a Poly(butyleneterephthalate)(PBT) polyester. A Valox DR48 header and cup can withstand the rigors of the automotive environment and are capable of being ultrasonically welded together.

One embodiment of the present invention uses a metal bridgewire for a resistor, and metal resistance welds to provide high reliability in attaching the bridgewire to the pins. It also minimizes the risk of contaminating or interacting with the primer or output charge because there is no solder or flux.

The present invention provides a small loop in the bridgewire as a stress relief to provide for the situation where the metal pins move because of thermal expansion and contraction of the plastic header.

In a preferred embodiment, the present invention uses $BKNO_3$ (boron/potassium nitrate) as an output charge for at least three reasons. First, $BKNO_3$ ignition and combustion characteristics are much less sensitive to moisture than conventional black powder. This helps make the present invention more reliable and predictable in the field and easier to manufacture. Second, $BKNO_3$ produces more hot particles and more metallic slag than black powder. This helps the present invention ignite the gas generant more efficiently than conventional initiators. Third, $BKNO_3$ is less susceptible to ESD than black powder. This makes constructing and using the present invention safer than constructing and using conventional initiators.

The present invention provides for doping the primer with microscopic particles of aluminum powder to increase the heat transfer characteristics of the normal lead styphnate based primer.

The present invention attaches the cup to the header using an ultrasonic weld. This weld provides a high quality environmental seal between the header and the cup. In an alternate embodiment, the cup can be attached to the header with a thermal weld.

The present invention uses a thermally stable and resilient binder to provide a primer that is more resistant to long term, high temperature aging and thermal shock. This binder is resilient, and thus protects whatever device, such as a metal bridgewire, is used for the resistor from mechanical shock during the ultrasonic welding process.

In addition, the present invention's use of a plastic with high dielectric strength provides good ESD protection. The ultrasonic weld prevents an air path for discharge. The use of a sufficient thickness of the plastic with high dielectric strength insulates the primer and output charge from ESD avoiding the need for a separate spark gap.

One aspect of the present invention increases the no-fire capability of the part by providing an inert material that surrounds the heads of the pins inserted into the header. The inert material has better heat transfer characteristics than the plastic header. Using the inert material to fill the void between the pins reduces the volume that the primer has to occupy. This reduces the quantity of primer required. Reducing the amount of primer facilitates using a different primer composition, particularly a composition with less binder material. Using less binder material increases ignition reliability.

Using an inert material to surround the heads of the pins also helps to eliminate the formation of voids in the primer around the bridgewire. Voids can be created by the solvent in the primer evaporating too rapidly. Reducing the depth of the primer also controls the creation of voids in the primer. Compared to the thermal conducting characteristics of the primer, voids act as thermal insulators. Therefore, voids formed on the bridgewire inhibit ignition, and may lead to an initiator that does not meet the all-fire requirement. Voids formed near the bridgewire or covering only a portion of it may result in local hot spots when a small amount of current passes through the bridgewire. These hot spots can ignite the ordnance with much less current than normally required. Therefore, voids can lead to an initiator that does not satisfy the no-fire requirement. Eliminating the formation of voids thus enhances initiator reliability.

An aspect of the invention permits the use of the a primer solvent with a relatively slow evaporation rate. The quantity and type of solvent affects the formation of voids. Reducing the quantity of primer applied in a single application reduces the amount of solvent used. This relaxes many of the constraints on the evaporation rate of the solvent. A slow evaporation rate reduces the formation of voids.

The inert material also provides additional retention force to hold the pins in the header.

An aspect of the present invention provides a rounded end to the output cup holding the output charge to prevent damage to the output cup and to the output charge when the cup is ultrasonically welded to the header. This rounded end improves the coupling of the ultrasonic energy and reduces the amount of energy required to form the ultrasonic bond. The rounded end also reduces the variation in energy required to manufacture each part. This, in turn, leads to less variation in the manufactured parts.

An aspect of the present invention provides a three layer ignition structure comprising a primer located near a resistor, a flash charge covering the primer, and an output charge on top of the flash charge. The composition of the primer can be adjusted to provide a wide degree of control of the all-fire and no-fire characteristics. The composition and quantity of the flash charge can be adjusted to generate ordnance output quickly once ignited. This provides a fast function time with little variance. The output charge composition can be adjusted to provide increased pressure and hot particles to maximize the impact of the pyrotechnic materials.

One aspect of the present invention reduces the variance in the no-fire and all-fire characteristics across all assembled part by lightly pressing the moist primer covering the bridgewire.

One aspect of the present invention uses a lead-free primer. Another aspect of the present invention uses a lead-free flash charge. Using a lead-free primer or flash charge removes a source of lead in the environment where the initiator is used.

Additionally, an embodiment of these primers has an enhance ability to adhere to the resistor and header. This further simplifies the process of ultrasonic welding the output cup to the header. Additionally, such a primer is also very resistant to the effects of moisture and electrostatic discharge, thus enhancing the reliability and safety of the initiator.

One aspect of the present invention decreases the electrostatic discharge sensitivity of an assembled part by applying a conductive material along the outside of the header body. This conductive material provides a conductive path from the metal can covering the plastic output cup to locations near the pins on the part. This reduces the size of the gap that a spark must jump on the outside of the part to discharge any electrostatic charge that has built up between the metal can and the pins. One way an electrostatic charge build-up can be discharge is by arcing in air from the metal can to the pins along the outside of the initiator. Another way an electrostatic charge build-up can discharge is by arcing through the ordnance to the pins inside the initiator. This internal arcing may ignite the ordnance. Providing a conducting path that reduces the size of the gap between the pins and the metal can makes it more likely that any electrostatic discharge will occur outside of the part and not along an arc that traverses the ordnance. This makes the part safer to handle.

One aspect of the present invention increases the ability of the part to withstand back pressure during ignition by providing a metal backing behind the initiator. An initiator is placed into a system with the intent that the particles and gasses created during ignition move in a particular direction, namely away from the header and into a gas generant. However, the mechanical forces created during ignition may also overstress the plastic and cause the header to rupture. This would permit some of the particles and gasses to flow away from the gas generant, thus decreasing the effectiveness of the initiator. A metal housing behind the initiator helps reduce the risk of this occurring by providing additional support to the header.

An aspect of the present invention provides for doping the primer with microscopic particles of zirconium powder to increase the heat transfer characteristics of the normal lead styphnate based primer.

DETAILED DESCRIPTION OF THE PREFERRED EMBODIMENT

The following description is the best contemplated mode of carrying out the invention. This description is made for the purpose of illustrating the general principles of the invention and should not be taken in a limiting sense. The scope of the invention is best determined by reference to the appended claims. In the accompanying drawings like numerals designate like parts in the several figures.

Figure 1:
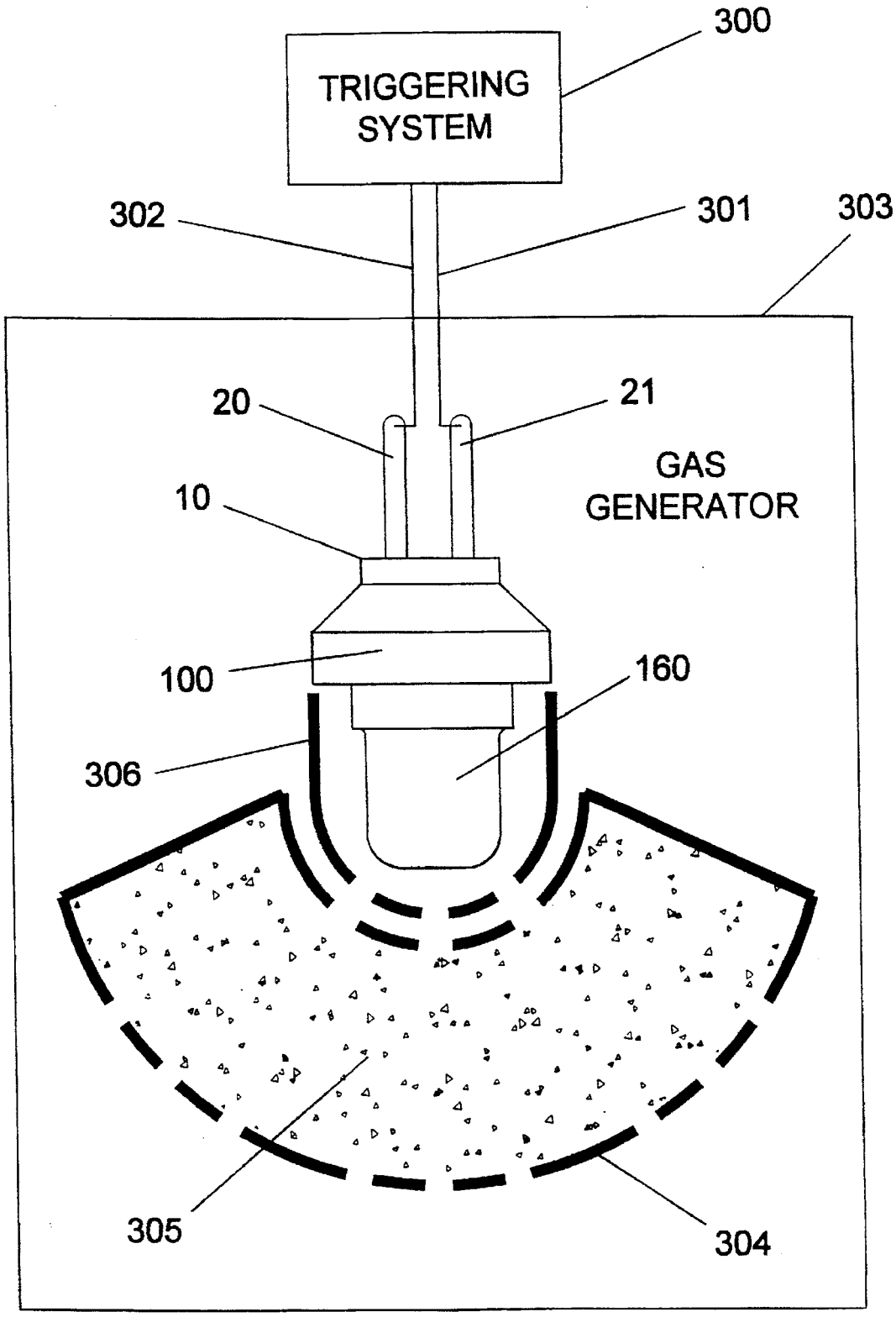
FIG. 1 is a block diagram of an embodiment of a gas generation system using an embodiment of an electrical initiator.

FIG. 1 is a block diagram showing how an initiator 10 of the present invention may be used as part of a gas generation system. The initiator 10 is connected to a triggering system 300 by electrical connections 301 and 302. The initiator 10 is within a gas generator 303. The gas generator 303 contains a gas generant enclosure 304 that holds a solid gas generant 305. The gas generant enclosure 304 has small holes on the surface located away from initiator 10 to allow gas created from burning solid gas generant 305 to exit the system. The gas generant enclosure 304 also has holes or burst regions on the surface closest to initiator 10. A director can 306 is a metallic container with holes that directs the gas and particles from a fired initiator 10 into the gas generant enclosure 304.

In an alternate embodiment, gas generant 305 could be something other than a pure solid. The gas generant 305 could be a gas that is heated or ignited by the initiator. In one embodiment, argon is used.

Figure 2:
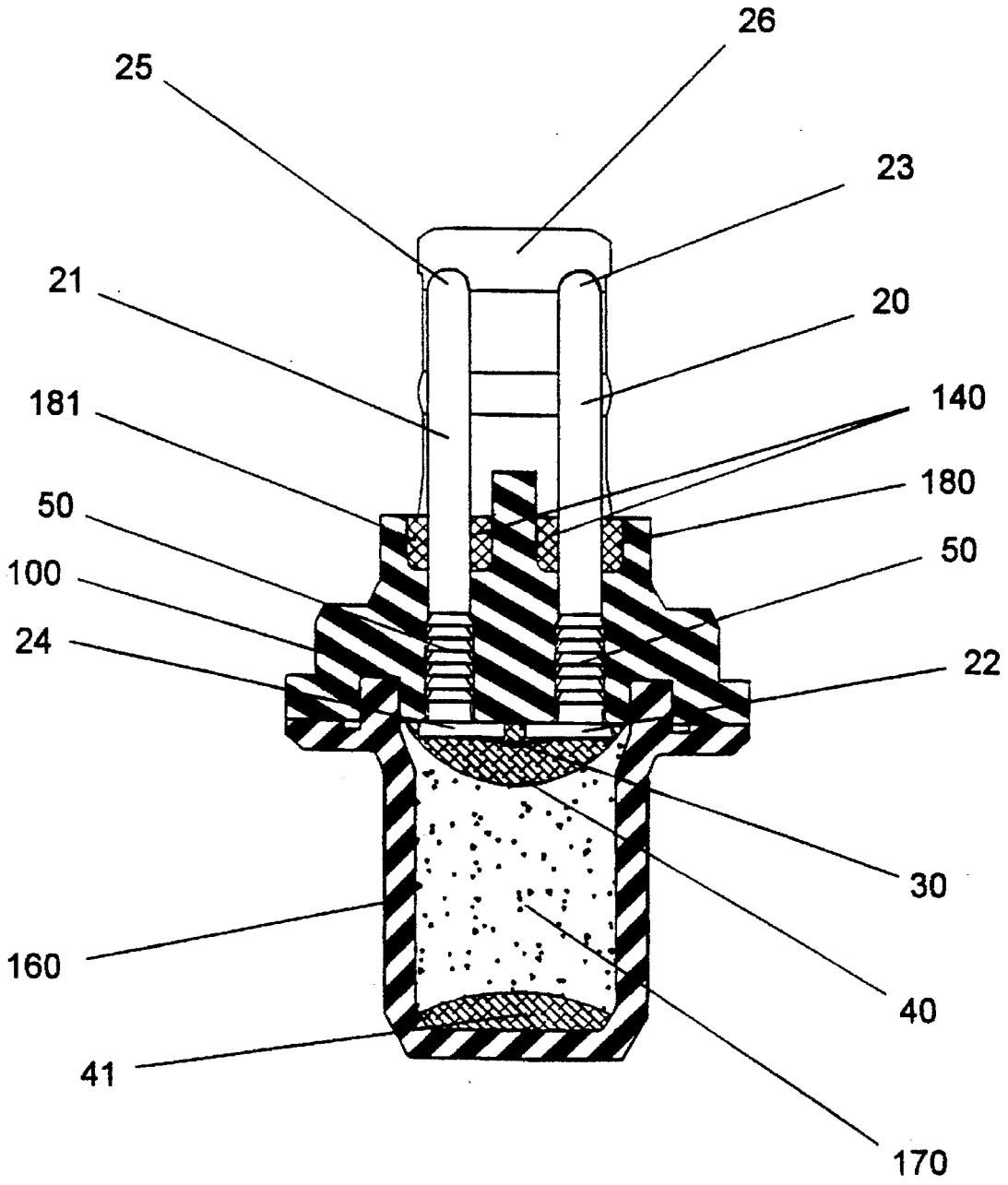
FIG. 2 is a cross-section of an embodiment of an electrical initiator.

FIG. 2 is a cross-section of one embodiment of the initiator 10 of the present invention. The initiator 10 includes a header 100 and an output cup 160 of an insulating dielectric material. The header 100 and the output cup 160 define an enclosure filled with an output charge 170, a first primer 40 and a second primer 41. A set of conducting metal pins 20 and 21 are embedded in the header 100. Pin 20 has an inner end 22, also called a pin head, and an outer end 23. Pin 21 has an inner end 24, also called a pin head, and an outer end 25. The pins 20,21 each have a buttress knurl 50 section which forms a seal with the header 100.

Figure 3:
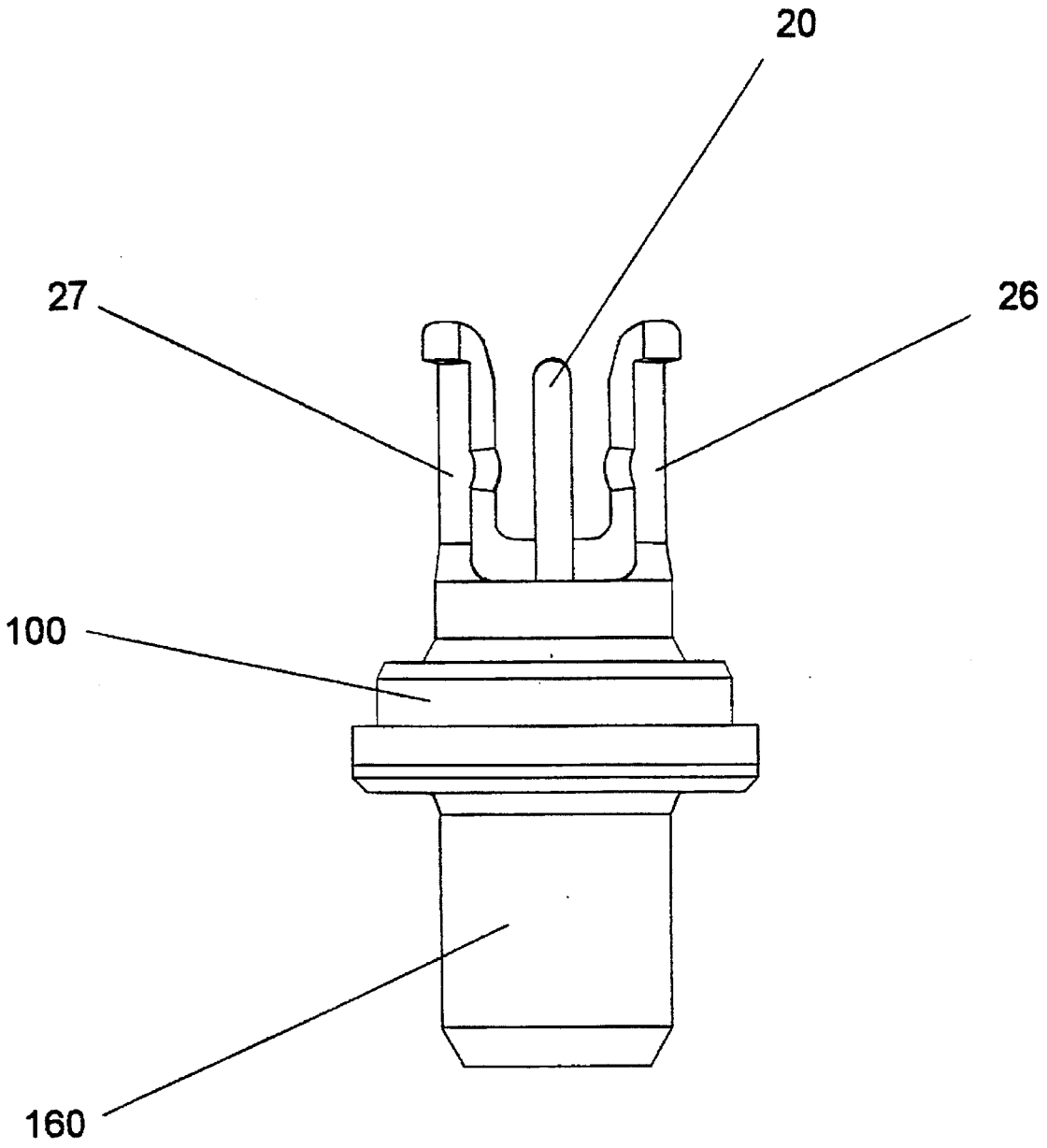
FIG. 3 is an external view of an embodiment of an electrical initiator.

FIG. 3 is an external view of the same embodiment of the initiator 10 shown in FIG. 2 except that the initiator 10 has been rotated 90°. Fingers 26 and 27 aid in maintaining the initiator's 10 connection to an external electrical connector (not shown).

The initiator of FIG. 3 could have its output cup 160 enclosed by a director can (not shown). The director can would channel the ignited output charge as shown in FIG. 1.

In FIG. 2, each pin 20,21 is preferably surrounded by an epoxy sealant 140 filling recesses 180 and 181. The portion of the pins 20,21 extending outside of the header 100 are used to connect initiator 10 to triggering system 300 (FIG. 1). Inner end 22 and inner end 24 extend into the enclosure formed by header 100 and output cup 160.

In an alternate embodiment, the epoxy sealant 140 is omitted, and the cavity for the epoxy sealant may be eliminated.

In order to convert the energy in the electric signal arriving at the pins 20,21 into thermal energy necessary to ignite first primer 40 and second primer 41, inner ends 22,24 need to be electrically connected together with some electrically resistive material or device. In a preferred embodiment, that connection is established with a bridgewire 30 composed of metal. In an alternate embodiment, the electrically resistive material or device can be a semiconductor bridge (not shown).

Figure 4:
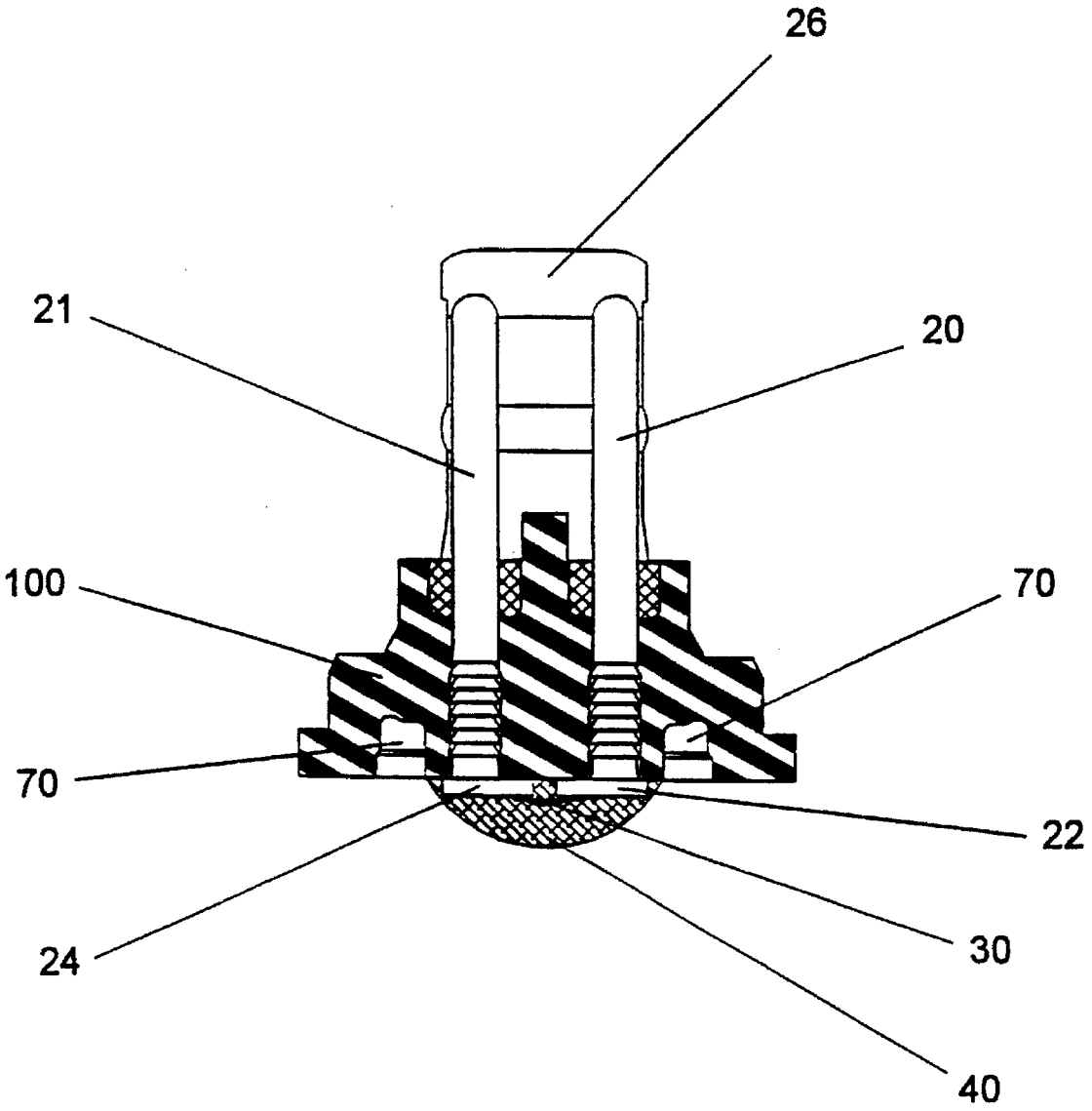
FIG. 4 is a cross-section of an embodiment of a header with pins installed.

FIG. 4 is a cross-section of the header 100 with pins 20,21 and bridgewire 30 of the same embodiment of the initiator 10 shown in FIG. 2. FIG. 4 shows the header before installation of the output cup 160. Cup well 70 provides a place to put the output cup 160 before ultrasonically welding it to header 100. Inner end 22 and 24 and bridgewire 30 make intimate contact with first primer 40.

As shown in FIG. 2, the second primer 41 is identical in composition to first primer 40 and is located at the opposite end of the output cup 160 from header 100. Second primer 41 is used to accelerate the burn rate of the output charge 170, and to simplify the manufacturing process. Proper ignition requires an appropriate total amount of primer. Placing all of the required primer on the bridgewire 30 can make manufacturing difficult. Putting second primer 41 in the output cup 160 means that less first primer 40 can be placed on the bridgewire 30 while still having the proper total amount of primer in the initiator.

In an alternate embodiment, second primer 41 could be of a different composition than first primer 40.

Figure 10:
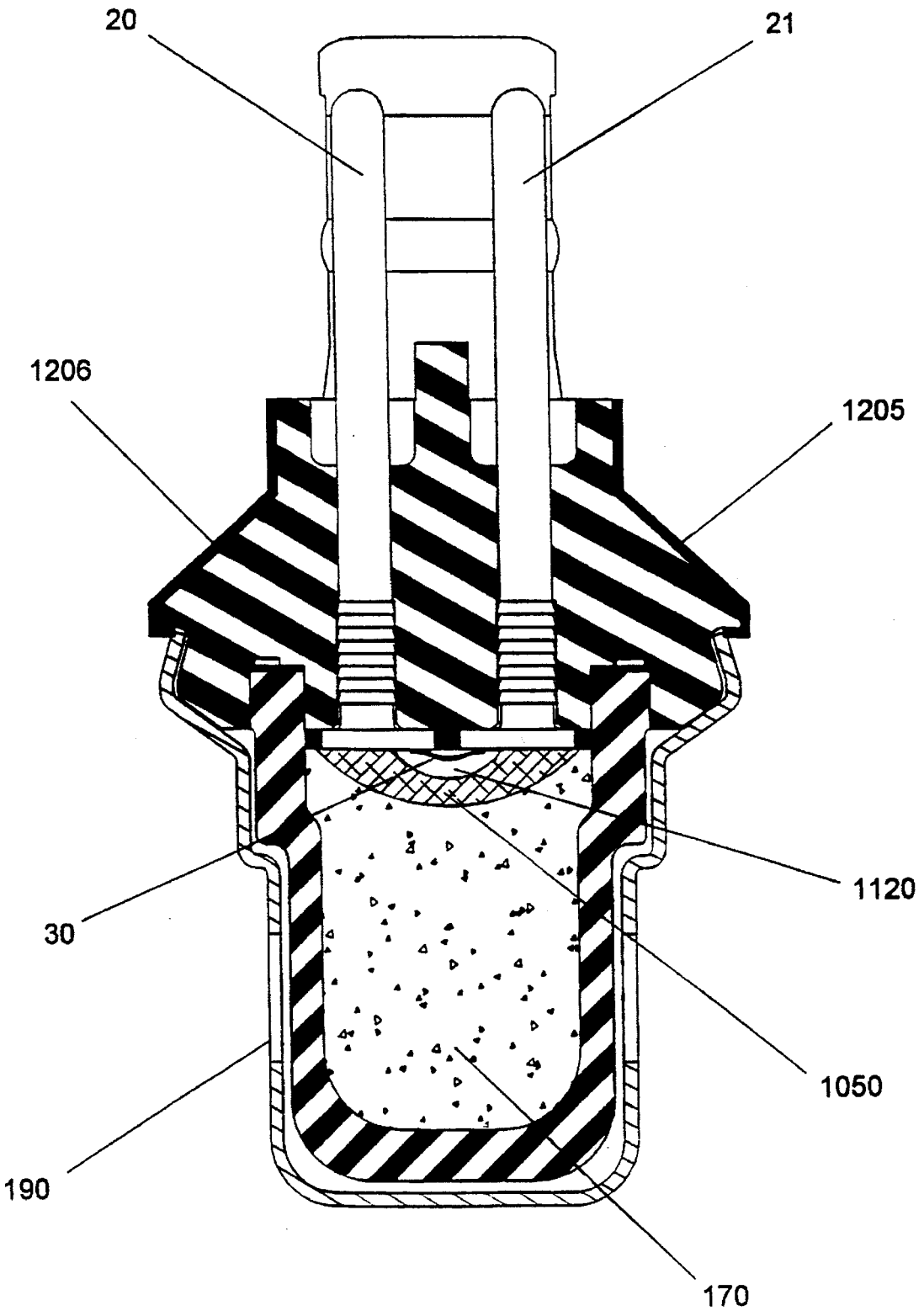
FIG. 10 is a cross-sectional view showing a three layer ignition structure and the conducting stripes.
Figure 11:
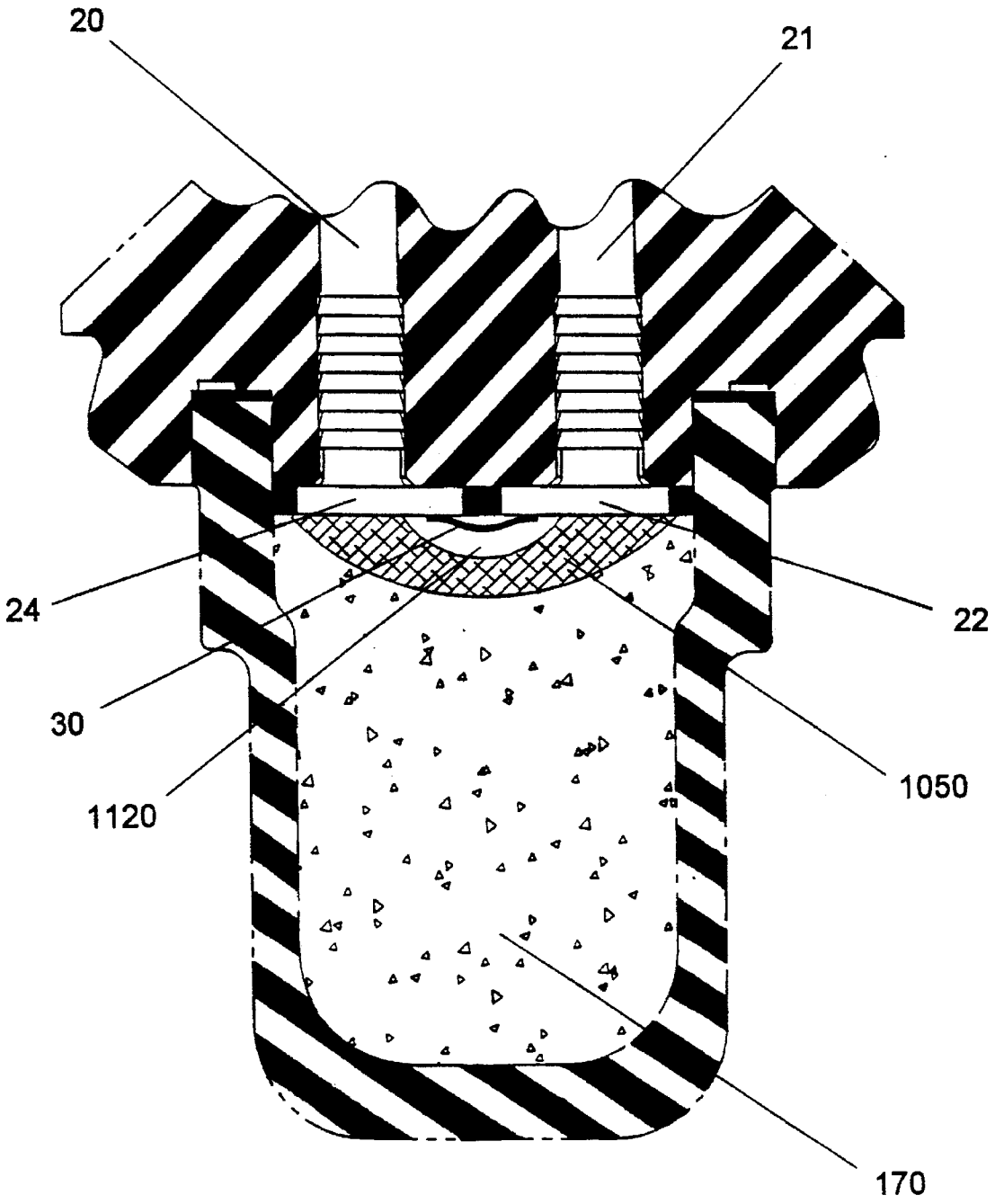
FIG. 11 is detailed cross-sectional view of the three layer ignition structure in FIG. 10.

FIG. 10 shows an initiator with a three layer ignition structure and a director can 190. FIG. 11 shows the three layer structure in greater detail. A primer 1120 would be located next to the bridgewire 30. A flash charge 1050 would cover the primer 1120, and the output charge 170 would be adjacent to the flash charge 1050. This permits optimizing the composition of the primer 1120 to emphasize all-fire and no-fire characteristics. The flash charge 1050 would be optimized to burn quickly once initially heated by the primer 1120. Additionally, the flash charge 1050 would also be optimized to ignite the output charge 170 promptly and completely.

The pins 20,21 are composed of stainless steel to promote a good weld to the bridgewire 30. Gold plating on the inner ends 22,24 will not allow an optimum bridgewire weld in these circumstances. Therefore, if gold plated pins are used, the gold plating should either be omitted from the inner ends 22,24 at the time the pins are plated or abraded off before welding.

In a preferred embodiment, bridgewire 30 is made from a nickel-chrome-iron alloy called Nichrome. Bridgewire 30 can also be composed of another metal, e.g. stainless steel or platinum. A preferred embodiment uses Nichrome because it has a large temperature coefficient of resistance (TCR) and welds well. The large TCR allows for a thermal transient test after bridgewire 30 is welded and after first primer 40 in FIG. 2, or primer 1120 in FIG. 11 is added. This test performs a quality check on the weld. This test also verifies that the primer 40 or primer 1120 has been applied and is making good contact with the bridgewire.

Instead of using a piece of metal to connect the inner ends 22,24 together, other resistive devices can be used. For example, a semiconductor bridge suitable for use in the initiator 10 is disclosed in U.S. application Ser. No. 08/023,075, filed Feb. 26, 1993 and commonly assigned to Quantic Industries, the disclosure of which is hereby incorporated by reference. Another embodiment for a semiconductor bridge is disclosed in U.S. Pat. No. 3,366,055 to Hollander, the disclosure of which is hereby incorporated by reference. Another embodiment for a semiconductor bridge is disclosed in U.S. Pat. No. 4,976,200 to Benson, et al. (Sandia), the disclosure of which is hereby incorporated by reference. Another embodiment for a semiconductor bridge is disclosed in U.S. Pat. No. 5,085,146 to Baginski, the disclosure of which is hereby incorporated by reference. A method for attaching semiconductor bridges to headers is disclosed in U.S. application Ser. No. 08/170,658, the disclosure of which is hereby incorporated by reference. The method for attaching semiconductor bridges to headers is also disclosed in Patent Cooperation Treaty application PCT/US94-01606, the disclosure of which is hereby incorporated by reference.

Figure 5:
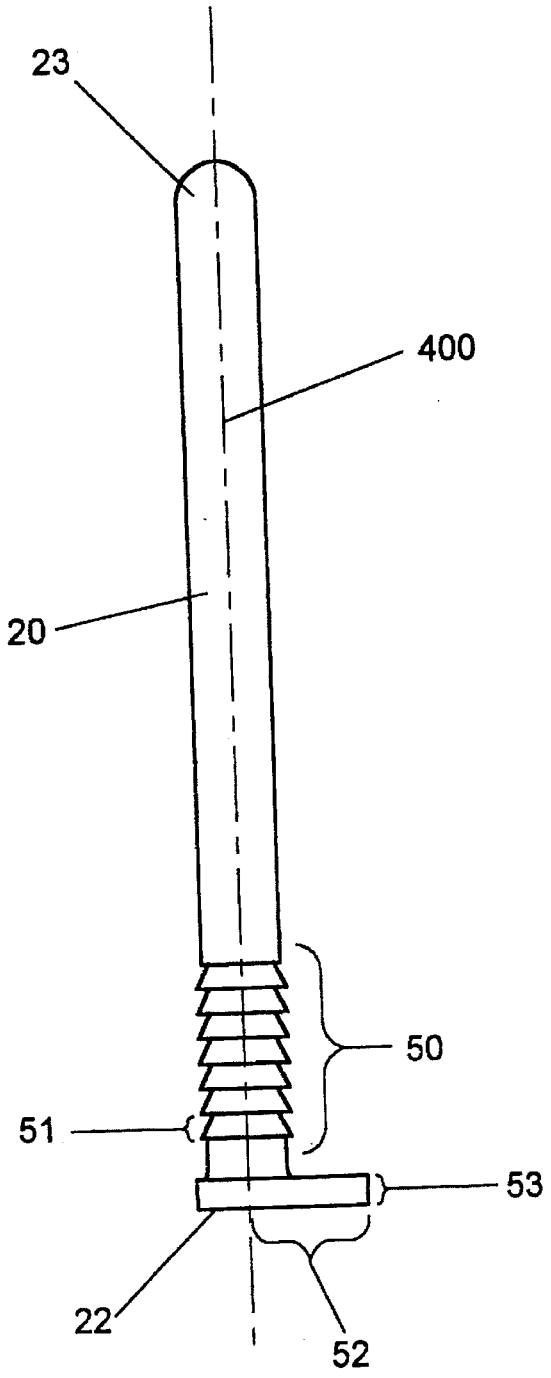
FIG. 5 is an external view of an embodiment of a pin showing a buttress knurl section.

FIG. 5 is an external view of pin 20 showing the inner end 22, outer end 23 and the buttress knurl section 50. The buttress knurl 51 is designed so that the sharp edges extend beyond the pin diameter. They are also designed to engage the header 100 (FIG. 4) in the opposite direction in which the pin is inserted. The design is manufacturable at a low cost by a conventional cold working process used for manufacturing screws or nails. The number of flutes was optimized for retention sealing and manufacturability. The critical features are number, spacing, angle, outside diameter, and their sharpness.

Figure 6:
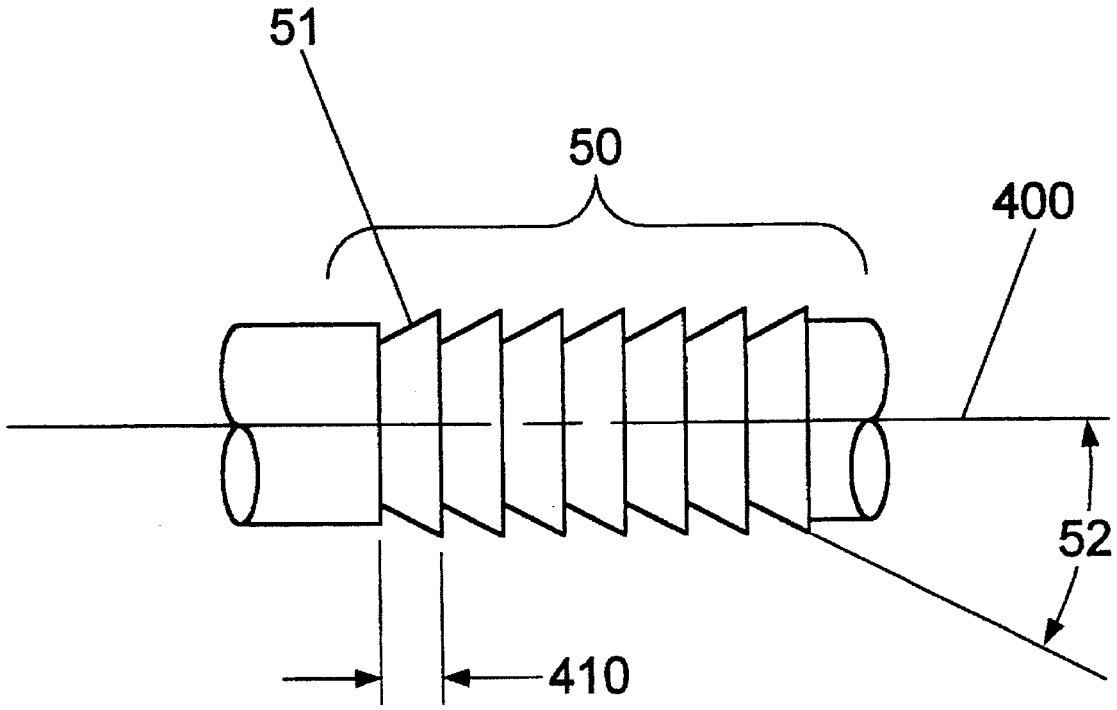
FIG. 6 is an enlarged view of an embodiment of a buttress knurl section.

FIG. 6 shows an enlarged view of a buttress knurl section of the preferred embodiment shown in FIG. 2. Favorable results have been obtained with the following specifications. The flute angle 52 is specified to be 30° off of pin center line 400. The spacing between flutes 410 is specified to be 0.3 millimeters. The flute extends 0.020 millimeters beyond the outer diameter of the pin 20,21. The outer edge of the flute should be made as sharp as possible.

Favorable results have been achieved with the following specifications for pins 20 and 21. The buttress knurl section 50 contains seven flutes 51. As shown in FIG. 5, the pin 20,21 is specified to be 11.0 millimeters from the side of the inner end 22,24 contacting the header 100 to the outer end 23,25. The pin 20,21 is specified to be 1.0 millimeters in diameter. The inner end 22,24 is specified to be 0.28 millimeters thick, as shown by dimension 53, and offset from pin center line 400 by 0.66 millimeters, as shown by dimension 52. The inner end 22,24 is also known as a pin head.

The operation of the initiator 10 begins with the arrival of an electrical signal at the pins 20 and 21. The electrical signal must produce enough current to heat the bridgewire 30 to the point where the first primer 40 ignites. The preferred embodiment requires 800 milliamps for 2 milliseconds to initiate ignition of the primer discussed below reliably.

For a specified electric current and voltage delivered by the triggering system 300, the ignition characteristics of the initiator 10 can be changed by changing the composition of the primers 40,1120, or the resistivity, diameter and length of the bridgewire 30. Changing the composition of the primers 40,1120 changes the heat sensitivity, thus making it easier or harder for the primers 40,1120 to ignite for a given amount of delivered electric energy. Changing the resistivity, diameter or length of the bridgewire 30 changes its electrical characteristics, thus determining the amount of heat per unit area that the bridgewire 30 produces. In one embodiment, the bridgewire 30 is 0.040 inches long and 0.0009 inches in diameter.

The first primer 40 and the second primer 41 are composed of normal lead styphnate, a binder material, a heat transfer agent, and a solvent. A good choice of a binder material is Fluorel 2175, a fluoroelastomer similar to Kel-F. Fluorel 2175 is a copolymer of Vinylidine Fluoride ($VF_2$) and Hexafluoropropylene (HFP). Kel-F is more widely used but more expensive than Fluorel 2175. Kel-F is a copolymer of Vinylidine Fluoride ($VF_2$) and Chlorotrifluoroethylene. One could also use Kraton which is a thermoplastic rubber, or Viton A or B which are rubber compounds. Kraton is available in a variety of polymers and compounds. In particular, the Kraton D rubber series includes linear styrene-butadiene-styrene and styrene-isoprene-styrene polymers. The Kraton G rubber series includes styrene-ethylene-butylene-styrene polymers, a styrene-ethylene-propylene copolymer or a multi-arm ethylene-propylene copolymer. Other forms of Kraton include polymers of the radial $(A\text{-}B)_n$ type: $(\text{styrene-butadiene})_n$ or $(\text{styrene-isoprene})_n$-, polymers of the diblock (A-B) type: styrene-butylene, styrene-ethylene/propylene and styrene-ethylene/butylene and $(\text{ethylene-propylene})_n$ polymers. Kraton FG includes styrene-ethylene/butylene-styrene polymers functionalized with about 1% succinic anhydride. Viton A is a fluoroelastomer. Viton B is a terpolymer of fluoroelastomer. Aluminum powder or zirconium powder make a good heat transfer additive. Favorable results have been achieved when the primer proportions by dry weight are 85% normal lead styphnate, 5% aluminum, and 10% Fluorel 2715. The aluminum can range from 3% to 10%, the Fluorel can range from 6% to 12% with the normal lead styphnate comprising the balance. A solvent is added to this mixture to allow the primer to be applied. A 50%-50% mixture of MIBK or MEK and N-butyl acetate makes a good solvent. To make the primer slurry needed for making the initiator, it is preferred to add an amount of the specified solvent composing 30% of the weight of the dry primer. For best results, the slurry should be of a uniform consistency. Therefore, the slurry should be kept agitating until it is used.

Zirconium/potassium perchlorate could be used instead of normal lead styphnate as the energetic material, but it is not as temperature sensitive. However, zirconium/potassium perchlorate does not need to have aluminum added because the zirconium provides good heat transfer characteristics. Favorable results could be achieved using a zirconium/potassium perchlorate mixture with 45% to 55% zirconium by weight with the balance being potassium perchlorate. The zirconium/potassium perchlorate mixture can be combined with a binder that composes 3% to 10% by weight of the zirconium/potassium perchlorate and binder mixture.

Additionally, the primers 40, 1120, and flash charge 1050 must be resilient enough to withstand damage from vibrations from the ultrasonic welding process which connects the output cup 160 to the header 100. The choice of materials in this embodiment provides primers 40,41,1120, and flash charge 1050 that do not transfer damaging vibrations to the bridgewire 30.

FIG. 11 shows a three layer ignition structure. In one favorable embodiment, the primer 1120 is composed of 10%–50% normal lead styphnate, 1%–10% –325 mesh flake aluminum, 15%–40% zirconium with a nominal particle size of 2.5 microns, plus or minus 1 microns, 20%–50% $KClO_4$ with a nominal particle size of 10–20 microns, 1%–7% Kraton G, and 0.5%–4% Kraton FG, with all percentages by weight. In one embodiment, the primer 1120 is composed of 28.36% normal lead styphnate, 3.07% flake aluminum, 29.97% zirconium, 34.88% $KClO_4$, 2.56% Kraton G, and 1.16% Kraton FG, with all percentages by weight. In one embodiment, Kraton G-1652 and Kraton FG-1901X are used.

The Kraton FG binder is very resistant to the ultrasonic weld process used to assemble the initiator. Kraton FG and Kraton G are thermoplastic rubbers that are often described as solution cast thermoplastic rubbers. Solution cast means that the material dissolves in a suitable solvent, e.g. toluene, N-amyl acetate, cyclohexane, or others. The addition of the small percentage of Kraton FG to the mix improves the adhesion of the primer and flash charge to the header and bridgewire. It also improves the uniformity of the material. There must be a careful balance between the amount of binder and the rest of the materials. If Kraton FG is used instead of the combination of Kraton G and Kraton FG, the binding action is so strong that the ordnance output is inhibited. Additionally Kraton FG is prone to the formation of voids so the amount used must be minimized. If Kraton G is used instead of the combination of Kraton G and Kraton FG, more binder by weight is required to achieve similar binding action and the ordnance output is reduced. Kraton FG and Kraton G are available from the Shell Chemical Company, 4225 Naperville Road, Suite 375, Lisle, Ill. 60532-3660. The material is described in a data sheet available from Shell Chemical entitled "Kraton Thermoplastic Rubber, Typical Properties, 1992."

Other binder combinations could be developed by one skilled in the art including the use of energetic binders and other rubbery binders such as the traditionally used Viton A and B developed by Dupont. The essential property of the binder is that it must provide a resilient homogenous matrix to support the other materials and survive the ultrasonic welding and thermal shock environment without significantly retarding the ordnance output. Traditional nitrocellulose binders for NLS are not sufficiently thermally stable for use in initiators and are too brittle to survive the ultrasonic welding process.

The primer in the three layer ignition structure shown in FIG. 10 is made by ball milling −100 mesh normal lead styphante for 24 hours to produce a material with 3 to 5 micron mean particle size. This dry material is then mixed in a ball mill with 300 grams of one-quarter inch stainless steel balls with the materials in the proportions described previously using Toluene as a solvent. The solvent is then evaporated and approximately 35 milliliters of N-Amyl Acetate is added per 50 grams as a solvent. The material is then mixed in a magnetic stirrer and applied to the resistor that is installed in the header by brushing or dispensing during the assembly process described later.

The increase in the zirconium and $KClO_4$ increase the no-fire level of the primer 1120. The reduction in the amount of the binding material improves the ordnance output because the binder retards thermal propagation. The change in solvents and the addition of Kraton FG makes the primer stick to the resistor more tenaciously than the first primer 40, even though less binding material is used.

In a favorable embodiment, the flash charge 1050 used in the three layer ignition structure shown in FIG. 10 is composed of 0%–25% zirconium, 0%–25% $KClO_4$, 20%–80% −100 mesh normal lead styphnate, 5%–50% 3–5 micron mean particle size normal lead styphnate, 1%–5% Kraton G, and 0.1%–5% Kraton FG by weight. In one embodiment, the flash charge is composed of 7.5% zirconium, 7.5% $KClO_4$, 71% −100 mesh normal lead styphnate, 10% 3–5 micron mean particle size normal lead styphnate, 3% Kraton G, and 1% Kraton FG by weight. The $KClO_4$ in this embodiment is 24 hour ball milled to an average particle size of 3 to 8 microns. In one embodiment, Kraton G-1652 and Kraton FG-1901X are used.

A 50 gram batch of this material can be made by mixing the material with N-Amyl Acetate solvent for 15 minutes with 60 quarter inch steel balls on a 45 degree mil. After this, the material is magnetically stirred for at least one half hour before being applied to initiators by brush or dispenser. The flash charge 1050 is applied after the primer is applied and partially dried.

The flash charge 1050 includes larger particles of normal lead styphnate to improve thermal propagation.

Primer 1120 and flash charge 1050 also easily withstand the ultrasonic welding process, and are very resistant to the effects of moisture.

In one embodiment, a lead-free primer can be used instead of first primer 40, second primer 41, or the primer 1120 in the three layer ignition structure of FIG. 11. In a favorable embodiment, the lead-free primer has the composition 30%–60% zirconium, 30%–60% $KClO_4$, 1%–10% flake aluminum, 2%–8% Kraton G, and 0.1%–5% Kraton FG by weight. In one embodiment, the lead-free primer has the composition 43% zirconium, 50% $KClO_4$, 3% flake aluminum, 3% Kraton G, and 1% Kraton FG by weight.

The lead-free primer can be made by blending the materials in a blending jar with 300 grams of one-quarter inch hardened stainless steel balls for 20 hours with Toluene. The blended materials are then dried, and N-Amyl Acetate is added. This material is then mixed with a magnetic stirrer for 8 hours, and applied to parts with a brush or by dispensing.

In one embodiment, a lead-free flash charge can be used. In a favorable embodiment, the lead-free flash charge has the composition 10%–50% potassium ferricyanide (111) ($K_3Fe(CN)_6$), 30%–75% $KClO_4$, 0%–20% zirconium, 1%–8% Kraton G, and 0.5%–6% Kraton FG. In one embodiment, the lead-free flash charge has the composition 27.2% potassium ferricyanide (111) ($K_3Fe(CN)_6$), 63.4% $KClO_4$, 4.9% zirconium, 2.25% Kraton G, and 2.25% Kraton FG. These embodiments can also be used as a lead-free primer.

The output charge 170 needs to be composed of materials that will produce hot gases and particles that will cause the solid gas generant 305 to change into a gas. The output charge must also not degrade over time or with variations in temperature.

In one embodiment, favorable results are obtained when using 65 to 85 milligrams of $BKNO_3$ for the output charge 170, 20 milligrams of the favorable primer mix for the first primer 40, and 20 milligrams of the favorable primer mix for the second primer 41. In another embodiment, 50 milligrams of output charge 170 is preferred.

In a three layer ignition structure, favorable results are obtained when using 65 mg to 85 mg of $BKNO_3$ for the output charge 170, 5 mg of the favorable embodiment of primer 1120, and 25 mg of the flash charge 1050.

The header 100 and output cup 160 are injection molded from a material, such as Valox DR48, which is resistant to the automotive environment and which can be ultrasonically welded.

Another material that can be used for the header and the output cup is Valox 430, which is also a PBT resin (30% glass reinforced) and which has a higher glass content than the DR48 material. Also, Vectra 515, which is a liquid crystal polymer, made by Hoechst Celanese Advanced Materials Group in Chatham, N.J. can be used. Vectra 515 is a liquid crystal polymer with a low level of mineral filler based upon the wholly aromatic copolymer poly(benzoate-naphthoate).

Figure 12:
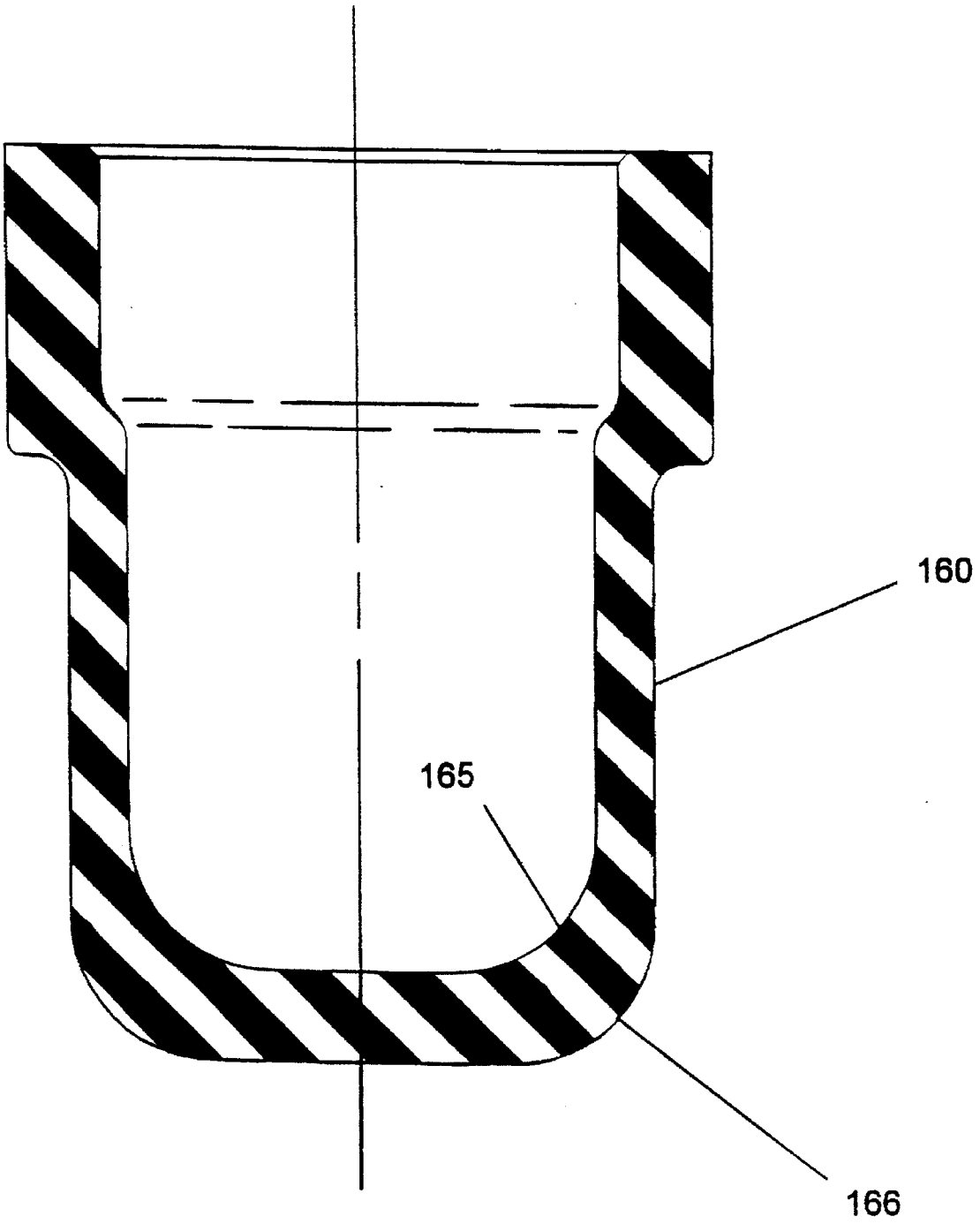
FIG. 12 is a cross-sectional view of an alternate embodiment of an output cup having rounded corners.

In one embodiment, the output cup 160 is shaped with a rounded external corner 166 and a rounded internal corner 165 to facilitate ultrasonic welding. This is shown in FIG. 12. The rounded corners reduce the welding energy required and eliminate output cup damage. Superior results have been achieved when the radius of the corners is 1.5 millimeters. In an alternate embodiment, the radii of each corner is different.

The pins 20,21 are formed with a buttress knurl 50. The pins 20,21 can be either machined or cold formed. Cold forming reduces cost. The knurl is an important factor in rigidly retaining the pins in the header and in providing a durable environmental seal. Each pin 20,21 is then inserted into the header 100 with a force of approximately 50–500 pounds, with 100 pounds preferred, so that each pin 20,21 is driven into the header 100 and the inner end 22,24 is in close proximity to the header. In one embodiment, the inner end is at an approximate height of 0.020 inches above the header 100. During this insertion the pins 20,21 are pushed into the header 100 so that the buttress knurl section 50 fully engages the header 100. In one embodiment, each pin 20,21 is inserted separately. When the insertion force is removed from a pin 20,21, the natural spring back of the plastic material comprising the header 100 forces the pin 20 or 21 back up. The buttress knurl section 50 as formed has sharp edges which bite or cut into the plastic of the header 100 when the pin 20 or 21 tries to spring back. This allows the buttress knurl 50 to bite into the header material like the back of a hook. This biting into the plastic forms a seal at each edge of the buttress knurl section 50. The multiple sharp edges of the buttress knurl section 50 provide an environmental seal between the pin 20,21 and the plastic comprising the header 100.

In an alternate embodiment, if the pin is slightly larger than the long hole that it is being inserted into, the pin can also establish a seal by an interference fit over the long length. Such a pin need not have flutes.

Then, to further assure the integrity of the seal, epoxy 140 is deposited and cured in the recesses 180,181 at the base of the header. In a preferred embodiment, a one part epoxy pre-form, such as a DC-003 Uni-Form can be used. DC-003 Uni-Form is available from Multi-Seals, Inc.

Figure 7:
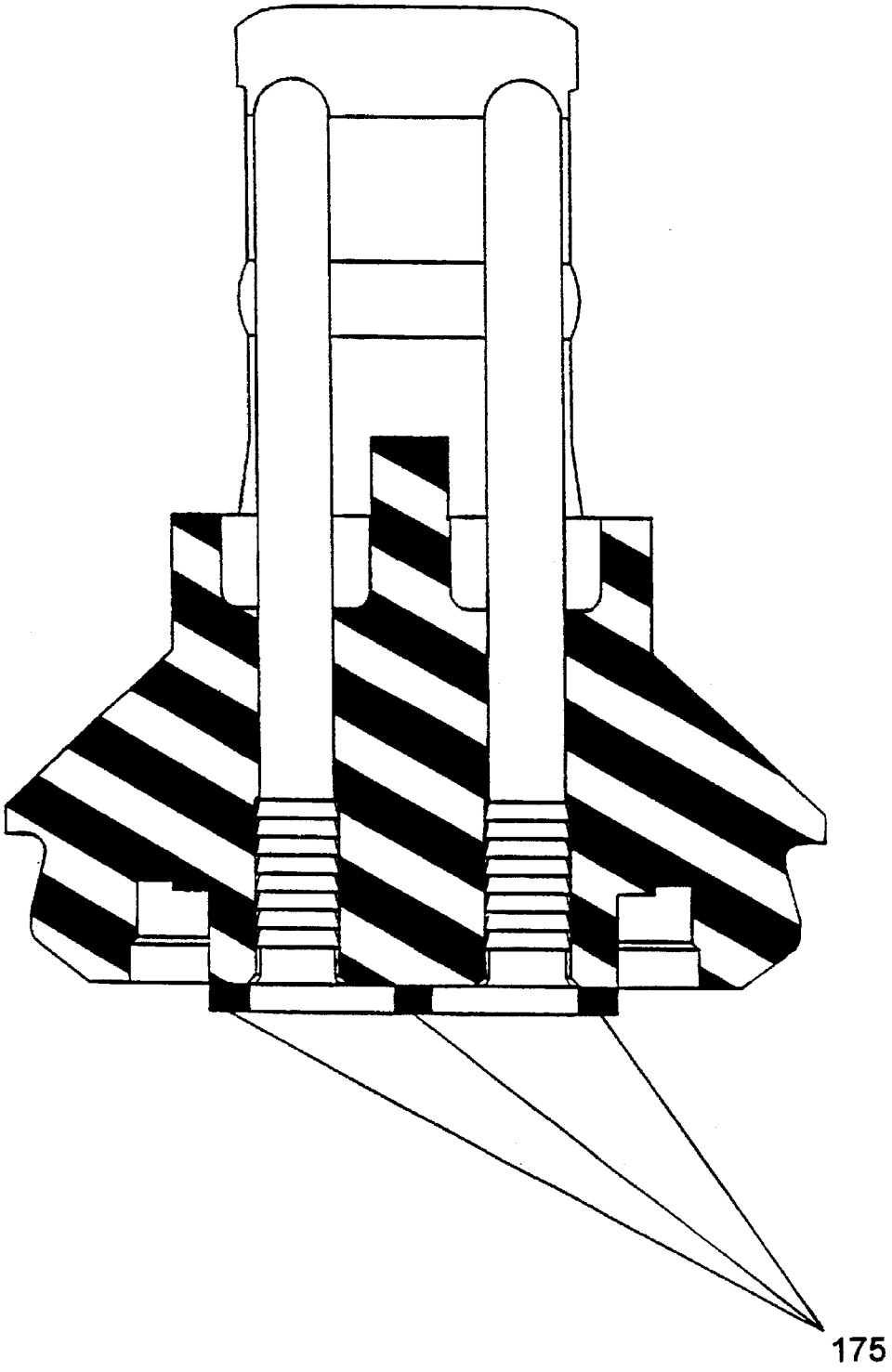
FIG. 7 is a cross-sectional view taken from the side of an alternate embodiment of a header with inserted pins showing the use of inert material between and around the heads of the pins.
Figure 8:
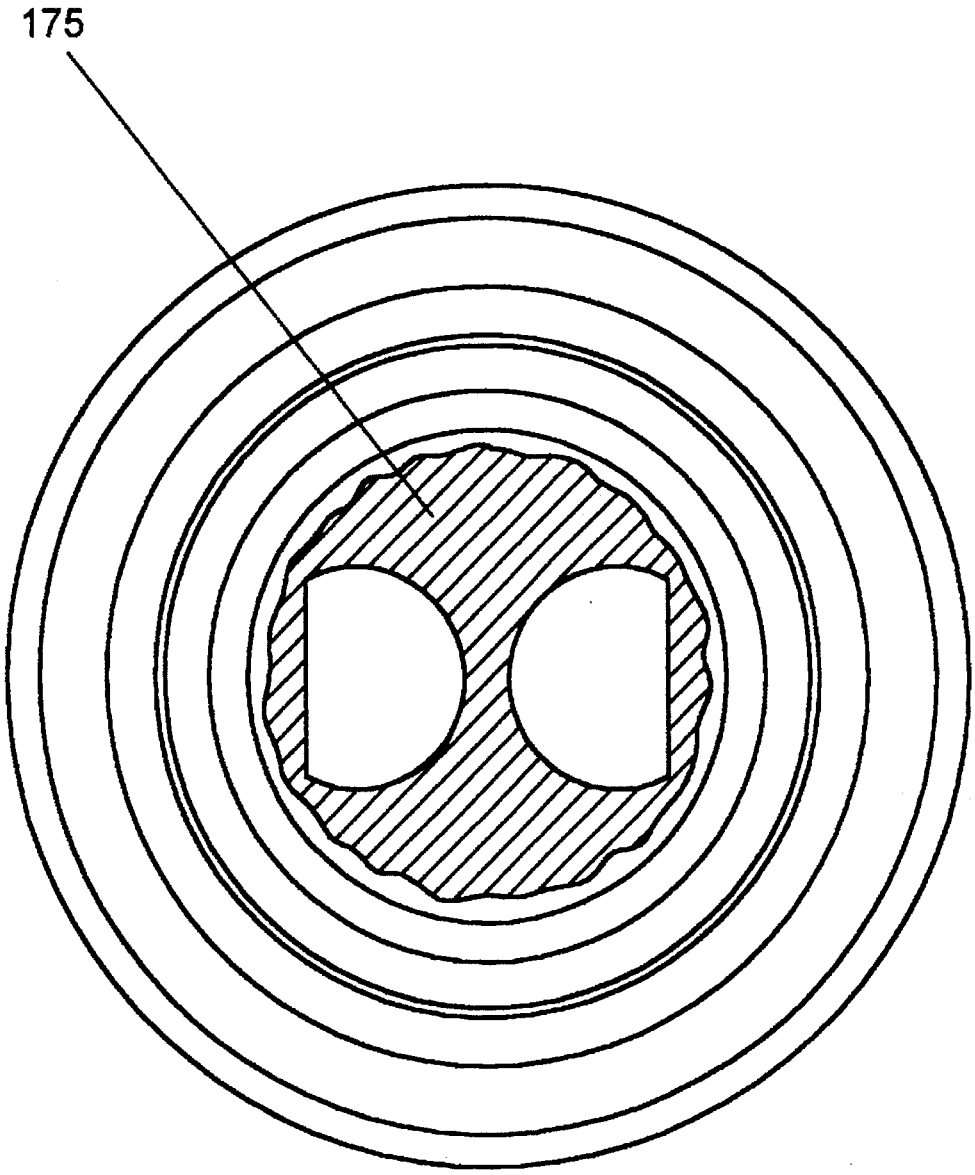
FIG. 8 is a view of the top of a header with pins inserted and with inert material surrounding the heads of the pins.

In one embodiment, shown in FIG. 7 and FIG. 8, the gap between the pins is filled with an inert material 175. To fill the gap, an inert potting material 175 is applied around the heads of the pins 20, 21 on the header 100. One choice for inert potting material is A2 with activator E, which was made by Armstrong which is a division of Morton International Specialty Chemicals Group of Warsaw, Ind. It is available from Resin Technology, 28 Norfolk Avenue, South Easton, Mass. 02375. The inert potting material is then cured. The pin head side of header 100 is then lapped to remove the potting material covering the heads of the pins 20, 21. The lapping operation will also remove any gold plating on the heads of the pins 20, 21.

In an alternate embodiment, the gap between the pins can be filled before applying the epoxy 140.

The next step is to resistance weld the bridgewire 30 to the inner ends 22,24. The bridgewire 30 is formed with a loop at the time it is welded to the pins 20,21 by one of two ways. Bridgewire 30 can be drawn over a half-round pin and welded at the end. Alternatively, the machine performing the weld can form the wire itself.

The first primer 40 is in the form of a slurry or suspension and is deposited on the bridgewire 30 by either a painting process or by dispensing it directly onto the bridgewire 30 with a series of automatic dispensing stations. One such station is an air over liquid dispenser made by EFD Inc. of Providence, R.I. Agitating the primer 40,41,1120 continuously during manufacturing keeps the primer homogenous. This helps achieve high process uniformity. The initiator 10 works best if the first primer 40 or 1120 covers the bridgewire 30 completely. After application, the solvent is evaporated from the slurry by placing the parts in an oven for about two hours at about 140° F.

When the second primer 41 is used, it is composed of the same material as the first primer 40, and is in a slurry or suspension form. It is placed in the bottom of the output cup 160, and dried in the same manner as the first primer 40.

In an initiator having the three layer ignition structure, the primer 1120 is applied to the bridgewire 30, by an EFD Dispenser Model 1000XL with a 21 gage needle. The formation of voids is eliminated by controlling the solvent evaporation rate by applying in a temperature controlled room at normal room temperature.

The flash charge is applied on top of the primer, as previously described. The flash charge is applied with the dispenser described above using an 18 gage needle.

In an alternate embodiment, the primer 1120 in a three layer ignition structure can be pressed onto the resistor before the primer dries. The pressing is performed by applying a light force with the end of a rod. Pressing the primer in this way reduces the variation in firing characteristics across all parts.

In an alternative embodiment, an initiator 10 can use the same material for both the primer and output charge 170. The choice of output charge and primer depends on the use intended and the cost of the materials. The primer must be sensitive to thermal energy. The output charge must provide the proper ignition characteristics for the gas generant which the initiator ignites.

In a preferred embodiment, an output charge 170 of $BKNO_3$ is a dry powdery or granular material such as a −20/+48 mesh. A fixed amount of the output charge is poured into the output cup 160.

Next, the header 100 with pins 20,21, bridgewire 30, primer 40, and epoxy sealant 140 installed is placed onto the output cup 160 and ultrasonically welded together. In alternate embodiments, header 100 can be thermally welded or attached with epoxy onto output cup 160.

Ultrasonically welding provides a cost effective mechanism for sealing a small part. A good ultrasonic weld provides a high quality environmental seal with good strength. Ultrasonic welding provides a very high manufacturing yield with automated equipment. Ultrasonic welding avoids the need for other equipment or materials used in other sealing techniques, such as epoxy with curing or inserting an O-ring. However, a thermal weld, epoxy, an O-ring, or other sealing method could be used to seal the output cup to the header.

An ultrasonic welding system that produces favorable results is made by Herrman Ultrasonics Inc., at 630 Estes Avenue, Shaumburg, Ill. In particular, this welder provides a fine degree of control over the forces used in the weld. The header should be mounted in the ultrasonic welder with a soft mounting, such as an O-ring. This will cushion the header against the mounting anvil. Additionally, the cup and header must be maintained in proper alignment. In one embodiment, a trigger force of approximately 10 pounds and a welding force of approximately 16 pounds is used.

Figure 17:
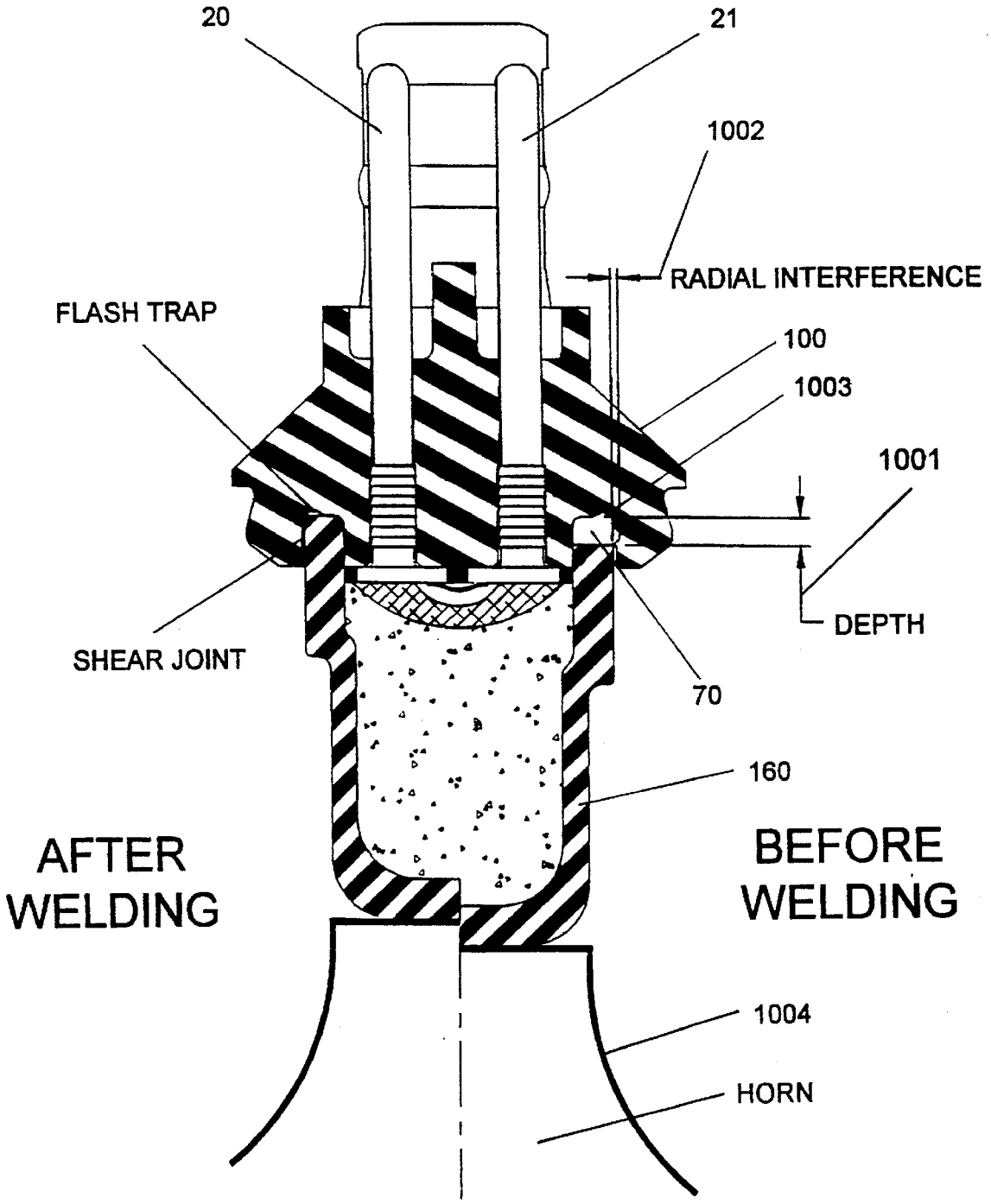
FIG. 17 is a cross-sectional schematic showing the ultrasonic welding process.

FIG. 17 shows the position of the header 100 and the output cup 160 both before and after the ultrasonic weld. The right side of FIG. 17 shows the output cup 160 placed on the horn 1004 and partially inserted into the cup well 70. The horn 1004 provides acoustic energy that vibrates the output cup 160 into the cup well 70. This melts the material comprising the header 100 and the end of the output cup 160 together to form a strong joint. The flash trap 1003 provides space for any excess material from the welding process to accumulate. The left side of FIG. 17 shows the position of the output cup 160 after the weld.

Figure 18:
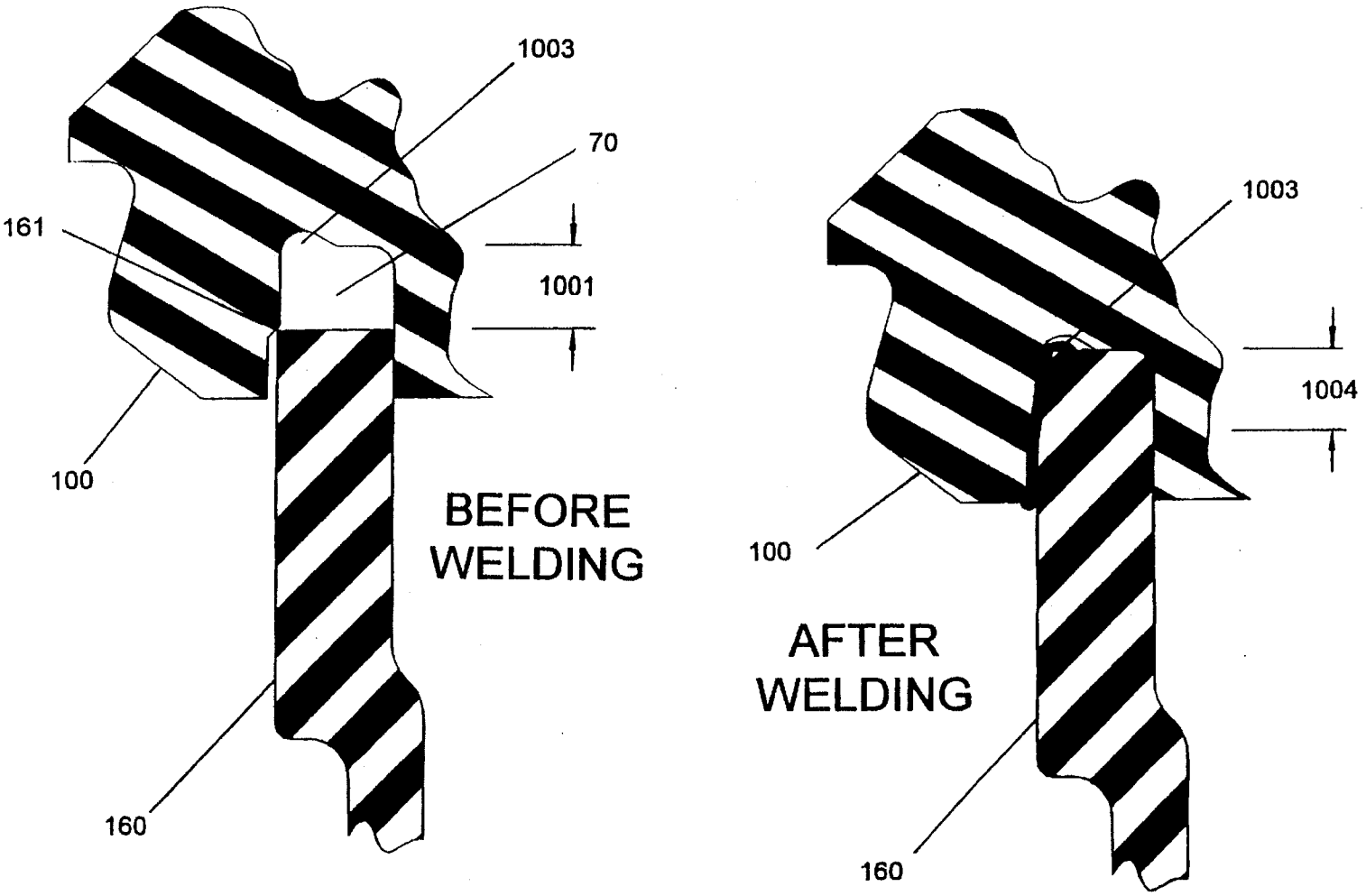
FIG. 18 is a cross-sectional view of a header illustrating the details of the cup well.

FIG. 18 shows a more detailed cross-section of the joint structure. The joint shown is a shear joint where the output cup 160 is driven against an interference 161 with 3 mils to 5 mils interference on the joint, with a 40 mils depth, shown by dimension 1001. The width of the output cup 160 wall is slightly greater than the width of the cup well 70. The ultrasonic welding process forces the output cup 160 into the cup well, and melts the plastic forming the two structures together. This establishes a tight, interference fit.

Figure 19:
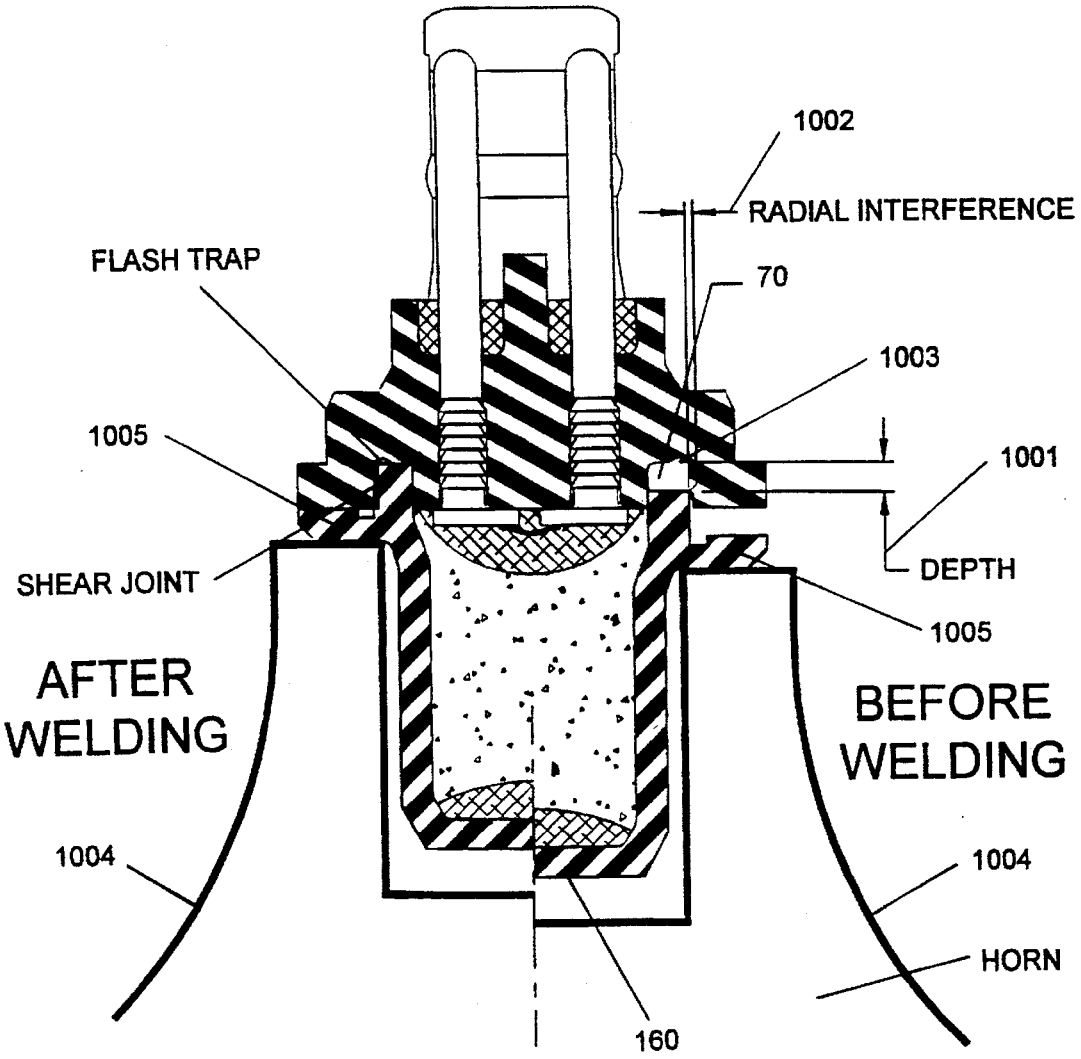
FIG. 19 is a cross-sectional schematic showing the ultrasonic welding process on an alternate embodiment of an initiator that has a flange.

FIG. 19 shows an alternate placement of the horn 1004 with respect to the output cup 160. Here, the horn rests on a flange 1005 adjacent to the vertical wall of the output cup.

Figure 9:
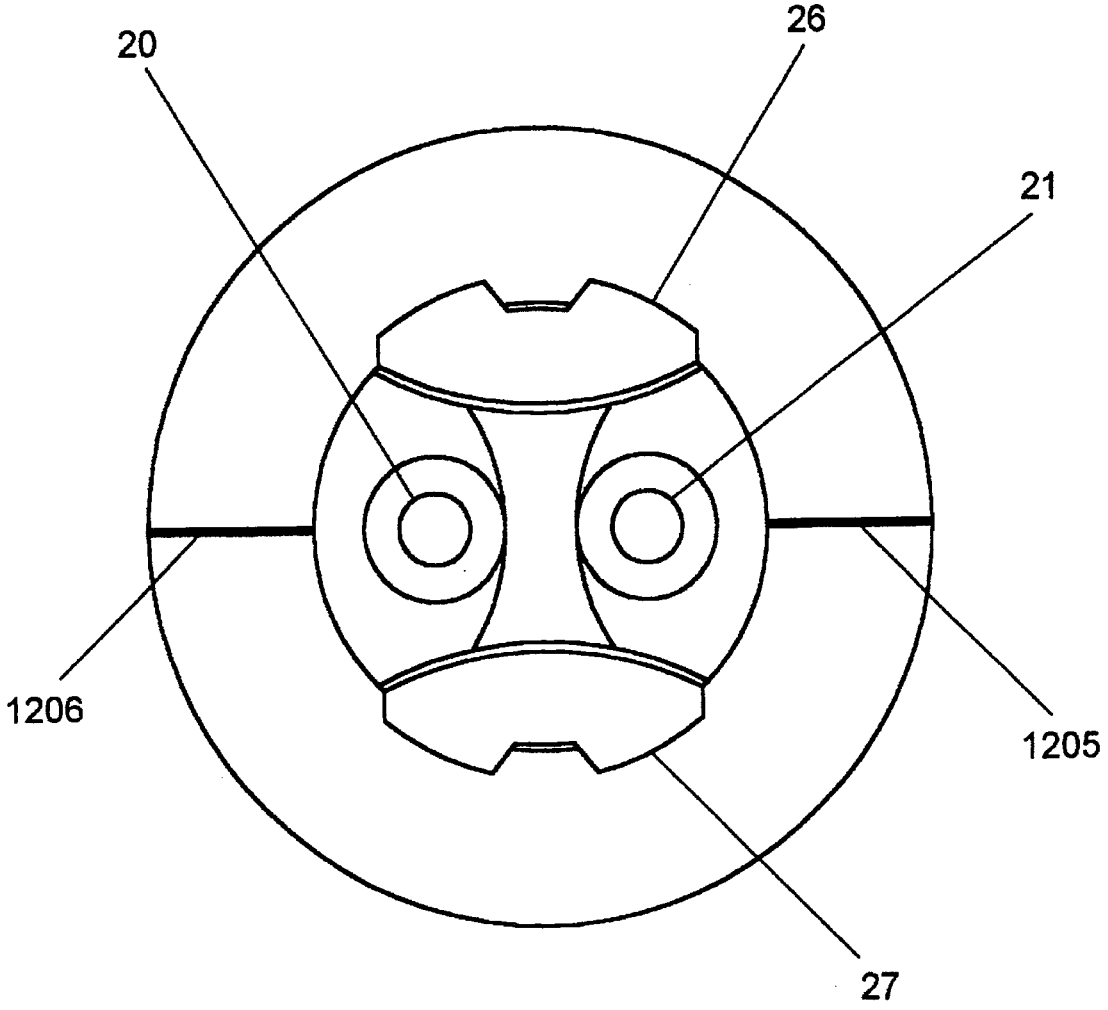
FIG. 9 is a bottom view of an initiator showing the conducting stripes.

After attaching the output cup 160 to the header 100, one or more electrically conducting ink stripes 1205,1206 are painted onto the outside of the initiator, as shown in FIG. 9 and FIG. 10. The conducting ink stripe reduces the risk that electrostatic charge applied to the outside of the initiator will discharge through the ordnance, primers or flash charge. Accidental electrostatic discharge presents a serious hazard during the manufacture and installation of an initiator. As shown in FIG. 9, the conducting ink stripes 1205, 1206 are closely adjacent to the conducting pins 20,21. The conducting ink stripes 1205,1206 reduce the gap between the conducting pins 20,21 and the metal director can 190. Providing such a small spark gap can provide a preferential safe discharge path with a breakdown voltage of approximately 3,000 to 6,000 volts. In addition, an electrically conductive ink stripe can be applied inexpensively with a brush or pen. Omitting a preferential spark gap leaves a potential discharge path between the director can and the head of the pin through the output cup 160, primer 40, 1120 and flash charge 1050.

As an alternate embodiment of a gas generating system 303 (FIG. 1), the initiator 10 can be modified to eliminate the need for a solid gas generant enclosure 304 (FIG. 1). This can be achieved by using a solid gas generant, such as a single base smokeless powder, instead of the output charge 170 (FIG. 2) in the output cup 160 (FIG. 2), and making the following modifications.

The output cup 160 (FIG. 2) must be expanded to accommodate the larger mass of the solid gas generant required to produce the gas. Second primer 41 (FIG. 2) is not required.

Figure 13:
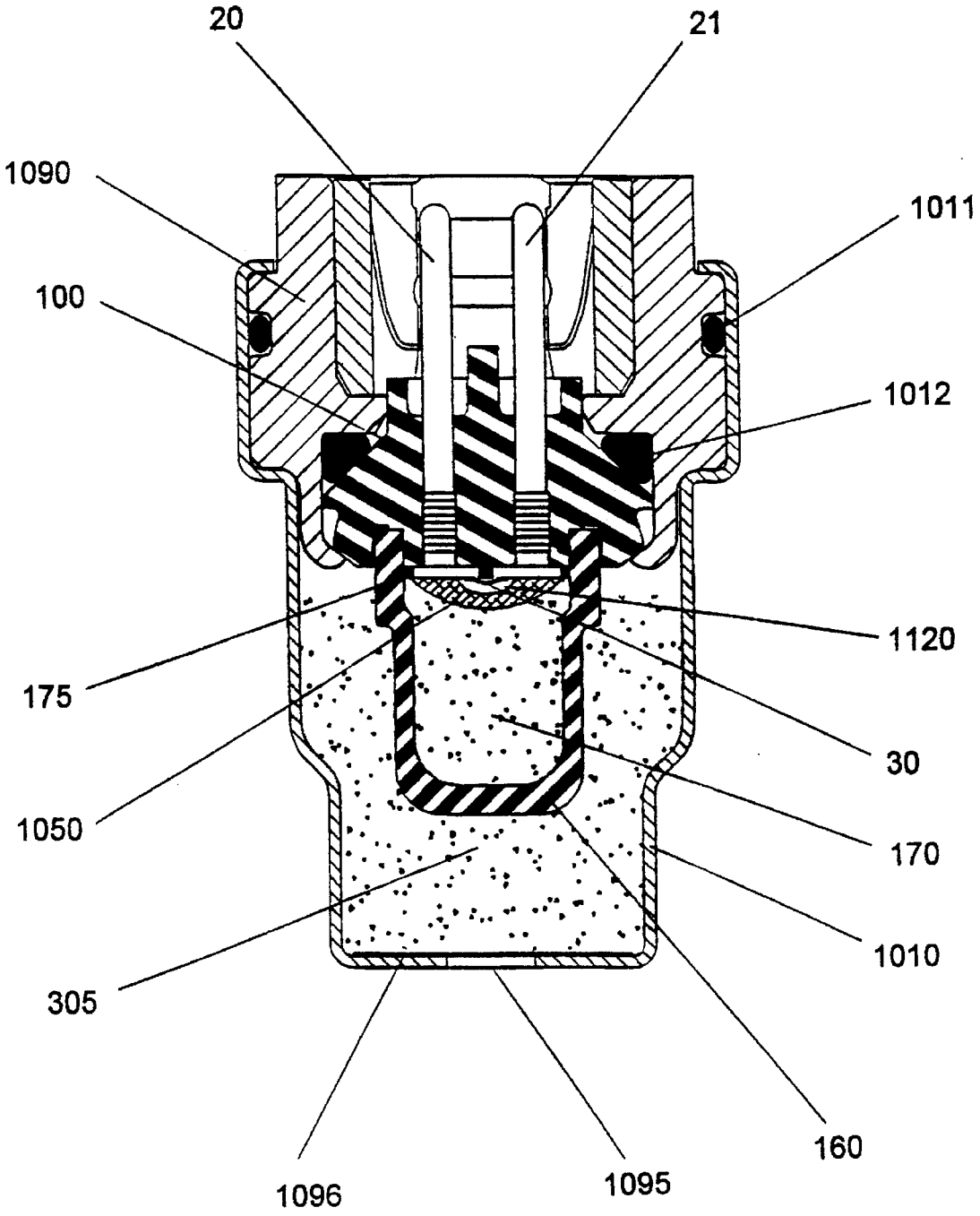
FIG. 13 is a cross-sectional view of an alternate embodiment of a gas generator.

FIG. 13 shows an alternate embodiment of a gas generator. Director can 1010 holds the gas generant 305. In one embodiment, the director can is composed of stainless steel. The initiator output cup 160 contains output charge 170. Flash charge 1050 surrounds primer 1120 that, in turn, surrounds bridgewire 30. Bridgewire 30 is welded to pins 20, 21. Gas generator base 1090 is composed of a machined or cast metal part that supports header 100. O-rings 1011, 1012 seal the director can to gas generator base 1090 and to the header 100. Seal 1096 closes the end of director can 1010. The combination of seals 1011, 1012, 1096, and the sealing of the pins 20,21 and the director can 1010 provide an environmental seal for the gas generant 305.

The gas generated by the combustion of gas generant 305 exits port 1095 in director can 1010, which is initially closed by seal 1096. The gas flowing out of the gas generation system can be used to operate mechanical devices, such as seatbelt pretensioners. If the pressure of the gas flowing out of the system increases too rapidly, the mechanical devices using the gas may be overstressed and damaged. The dimensions of the port 1095 can be set to reduce the rate that the pressure rises on the output side of port 1095. This avoids overstressing and potentially damaging any attached mechanical system. In one embodiment, port 1095 is approximately 0.075 inches to 0.250 inches in diameter. In a preferred embodiment, port 1095 is approximately 0.125 inches in diameter.

Figure 15:
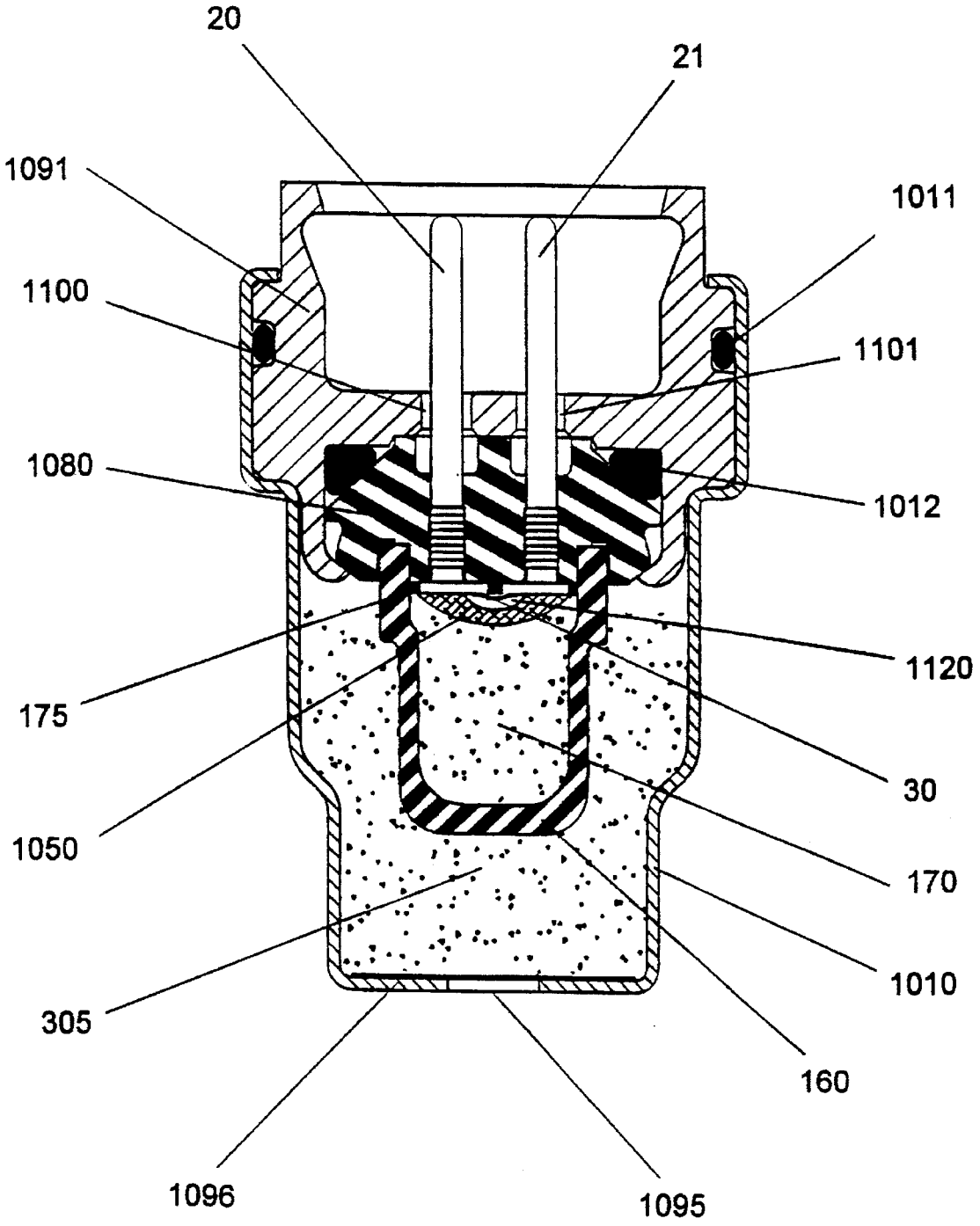
FIG. 15 is a cross-sectional view of an embodiment of a gas generator showing a metal plate backing with holes for the pins.

FIG. 15 shows an alternate embodiment of a gas generator that has a modified gas generator base 1091 with pin holes 1100 and 1101. Modified header 1080 differs from header 100 in that it lacks fingers 26 and 27 that were shown in the initiator of FIG. 3. Pins 20, 21 pass through the modified header 1080 to make electrical contact with external circuitry (not shown). The modified gas generator base 1091 provides a more complete metal backing for the initiator to reduce the risk that the pressure generated by the combustion of gas generant 305 will rupture the modified header 1080, and allow gas to exit out of the back of the part rather than through port 1095.

Favorable results have been obtained with the dual primer gas generator using 500 milligrams to 1500 milligrams of smokeless powder, and modifying the dimensions of the output cup 160 accordingly. Also, using 10 milligrams to 40 milligrams of the previously described primer mix yields good performance.

Favorable results have been obtained with the three layer ignition structure gas generator in FIG. 13 using 300 milligrams to 1500 milligrams of smokeless powder, ammonium perchlorate propellant, or $BKNO_3$ and modifying the dimensions of the director can 1010 accordingly.

Figure 14:
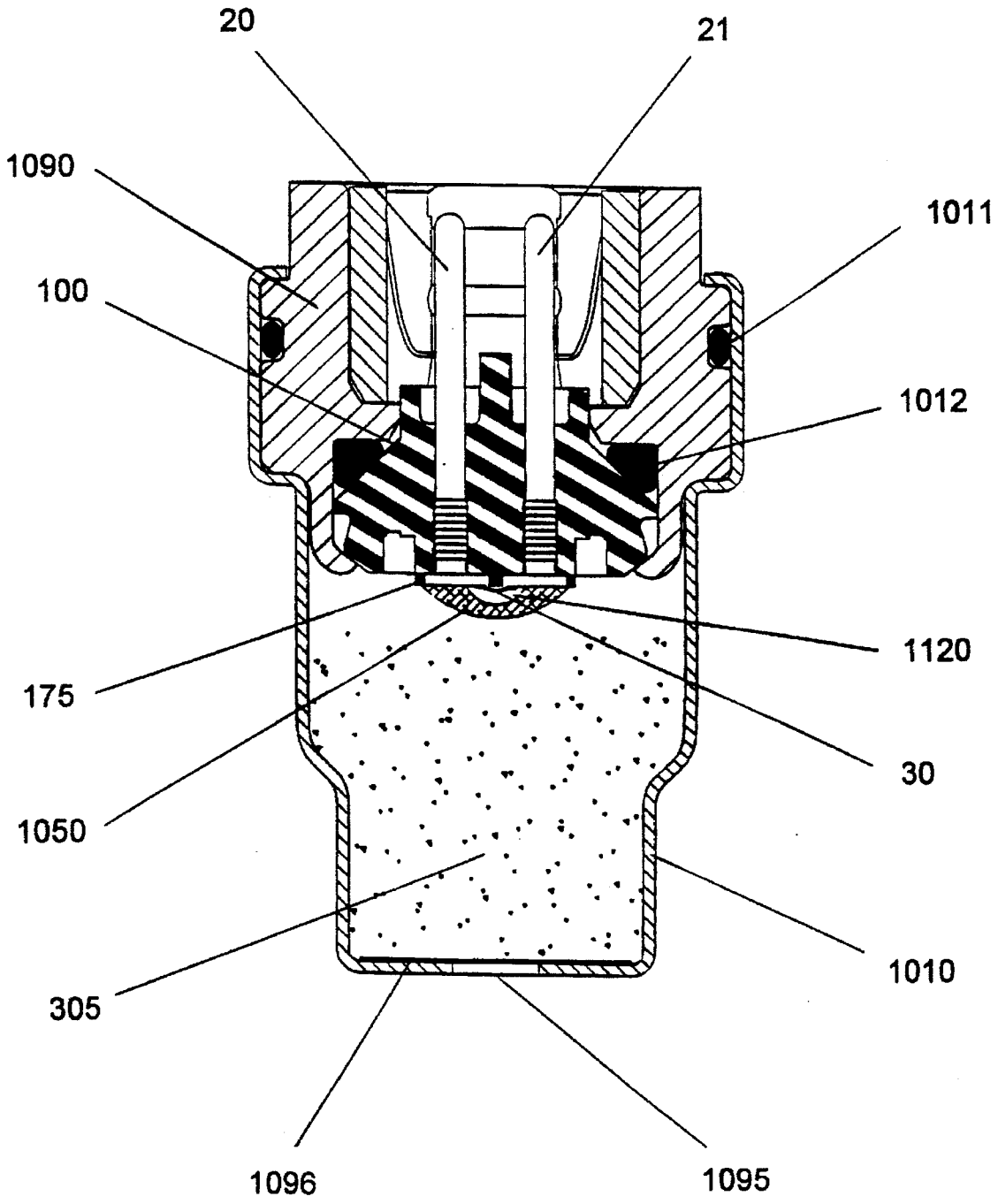
FIG. 14 is a cross-sectional view of an embodiment of a gas generator that uses only a primer, a flash charge and a gas generant.
Figure 16:
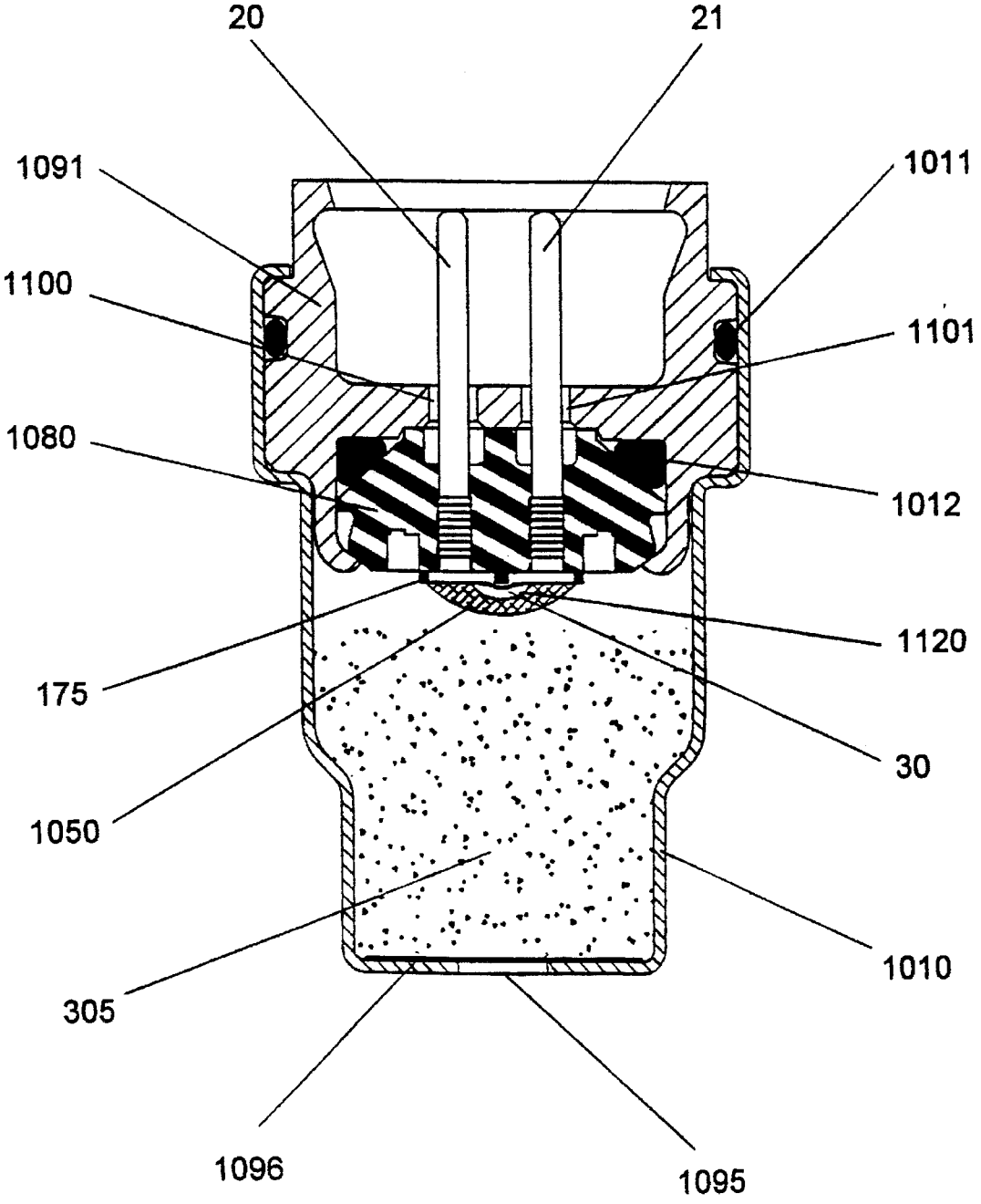
FIG. 16 is a cross-sectional view of an embodiment of a gas generator that uses only a primer, a flash charge and a gas generant, and has a metal plate backing with holes for the pins.

FIG. 14 and FIG. 16 show an alternate embodiment of the gas generator that eliminates output cup 160 and output charge 170. This design is more economical to construct, but requires that the primer 1120 and the flash charge 1050 be insensitive to ESD or the gas generator base 1090, 1091 provide a low voltage spark gap to the pins 20,21. In these embodiments, favorable results have been obtained using 25 milligrams to 60 milligrams of the flash charge 1050 over 5 milligrams of primer 1120. Using 300 milligrams to 1500 milligrams of smokeless powder, ammonium perchlorate propellant, or $BKNO_3$ and modifying the dimensions of the director can 1010 accordingly yields favorable results.

The solvent mixture component MIBK is methyl isobutyl ketone and is commonly available in the industry. The solvent mixture component MEK is methyl ethyl ketone and is commonly available in the industry. The solvent mixture component N-butyl acetate is commonly available in the industry. Black powder is made by Goex, among others, and is commonly available in the industry. Normal lead styphnate is made by Olin, among others, and is commonly available in the industry. Nichrome is a metal alloy that is commonly known and available in the industry. $BKNO_3$ is available from PSI and Tracor, and is commonly known in the industry. Smokeless powder is commonly known, and is available from IMR.

The following chemicals are commonly known to those skilled in the art of initiators. Valox DR48 is available from General Electric, and is polybutylene terephthalate (PBT). Fluorel 2175 is available from 3M. Kel-F is available from DuPont. Kraton is made by Shell Chemical. Viton A and Viton B are made by Dupont.

It will be appreciated by those of ordinary skill in the art that many variations in the foregoing preferred embodiments are possible while remaining within the scope of the present invention. This application includes, but is not limited to, automobile air bags, seat belt pretensioners, and other similar applications. The present invention should thus not be considered limited to the preferred embodiments or the specific choices of materials, configurations, dimensions, applications, or ranges of functional parameters employed therein.

What is claimed is:

1. An electrical initiator, comprising:

a bridgewire capable of converting electrical energy to thermal energy;

a primer covering the bridgewire;

a flash charge covering the primer; and an output charge adjacent to the flash charge;

wherein the primer includes about 1%–7% by weight of a compound selected from the group consisting of a styrene-ethylene-butylene-styrene copolymer, a styrene-ethylene-propylene copolymer, and a multi-arm ethylene-propylene copolymer; and about 0.5%–4% by weight of a styrene-ethylene-butylene-styrene copolymer functionalized with about 1% succinic anhydride.

2. The electrical initiator of claim 1, wherein said primer further comprises:

about 1%–10% by weight of aluminum;

about 15%–40% by weight of zirconium;

about 20%–50% by weight of $KClO_4$; and about 10%–50% by weight of normal lead styphnate.

3. The electrical initiator of claim 1 or 2 wherein the flash charge comprises:

up to 25% zirconium by weight;

up to 25% $KClO_4$ by weight;

about 20%–80% –100 mesh normal lead styphnate by weight; about 5%–50% normal lead styphnate with 3–5 micron mean particle size; about 1%–5% by weight of a compound selected from the group consisting of a styrene-ethylene-butylene-styrene copolymer, a styrene-ethylene-propylene copolymer, and a multi-arm ethylene-propylene copolymer; and about 0.1%–5% by weight of a styrene-ethylene-butylene-styrene copolymer functionalized with about 1% succinic anhydride.

4. An electrical initiator, comprising:

a bridgewire capable of converting electrical energy to thermal energy;

a primer covering the bridgewire;

a flash charge covering the primer; and an output charge adjacent to the flash charge;

wherein the primer includes about 30%–60% zirconium by weight;

about 30%–60% $KClO_4$ by weight;

about 1%–10% flake aluminum by weight;

about 2%–8% by weight of a compound selected from the group consisting of a styrene-ethylene-butylene-styrene copolymer, a styrene-ethylene-propylene copolymer, and a multi-arm ethylene-propylene copolymer; and about 0.1%–5% by weight of a styrene-ethylene-butylene-styrene copolymer functionalized with about 1% succinic anhydride.

5. The electrical initiator of claim 1 or 4, wherein the flash charge comprises:

about 10%–50% potassium ferricyanide (111) by weight;

about 30%–75% potassium perchlorate by weight;

up to 20% zirconium by weight;

about 1%–8% by weight of a compound selected from the group consisting of a styrene-ethylene-butylene-styrene copolymer, a styrene-ethylene-propylene copolymer, and a multi-arm ethylene-propylene copolymer; and about 0.5%–6% by weight of a styrene-ethylene-butylene-styrene copolymer functionalized with about 1% succinic anhydride.

6. An electrical initiator, comprising:

a bridgewire capable of converting electrical energy to thermal energy;

a primer covering the bridgewire;

a flash charge covering the primer;

an output charge adjacent to the flash charge;

a non-conducting header with a first conducting means and a second conducting means passing through the header, first conducting means and the second conducting means connected to the bridgewire;

an output cup including a dielectric material, the output cup coupled to the header and containing the primer, the flash charge, and the output charge;

a conducting director can covering the output cup and connected to the non-conducting header; and a conducting stripe painted on an outside surface of the header touching the director can and ending closely adjacent to one of said first conducting means and said second conducting means.

7. The initiator of claim 6, having a breakdown voltage between said director can and one of said first conducting means and said second conducting means of approximately 5000 volts.

8. An electrical initiator, comprising:

a header;

a first pin with a first inner end, the first inner end having a first head, the first pin passing through the header and the first head in close proximity to the header;

a second pin with a second inner end, the second inner end having a second head, the second pin passing through the header and the second head in close proximity to the header;

an electrically resistive device electrically coupled to and extending between the first head and the second head;

a primer that includes a binder, wherein the primer is slurried in a solvent that is capable of dissolving the binder and wherein the slurried primer is applied to cover the electrically resistive device; and an inert material disposed on the header between the first head and the second head wherein the inert material adjoins the slurried primer to reduce the amount of slurried primer needed to cover the electrically resistive device and wherein the primer includes: about 1%–7% by weight of a compound selected from the group consisting of styrene-ethylene-butylene-styrene copolymer, a styrene-ethylene-propylene copolymer, and a multi-arm ethylene-propylene copolymer; and about 0.5%–4% by weight of a styrene-ethylene-butylene-styrene copolymer functionalized with about 1% succinic anhydride.

9. The initiator of claim 8, further comprising:

an output cup ultrasonically welded to the header with the output cup and the header forming a cavity enclosing the primer, wherein the output cup and the header each comprise a dielectric material.

10. The initiator of claim 9, wherein said output cup has rounded corners.

* * * * *